US010647502B2

(12) United States Patent
Tarr

(10) Patent No.: US 10,647,502 B2
(45) Date of Patent: May 12, 2020

(54) PACKAGING APPARATUS AND METHOD FOR CEILING FAN

(71) Applicant: HUNTER FAN COMPANY, Memphis, TN (US)

(72) Inventor: Jeremy Tarr, Somerville, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 15/865,849

(22) Filed: Jan. 9, 2018

(65) Prior Publication Data

US 2018/0194544 A1 Jul. 12, 2018

Related U.S. Application Data

(60) Provisional application No. 62/444,400, filed on Jan. 10, 2017.

(51) Int. Cl.

| | |
|---|---|
| ***B65D 85/68*** | (2006.01) |
| ***F04D 25/08*** | (2006.01) |
| ***F04D 29/60*** | (2006.01) |
| ***B65D 81/36*** | (2006.01) |
| ***F04D 29/64*** | (2006.01) |
| *F04D 29/26* | (2006.01) |

(52) U.S. Cl.
CPC ..... *B65D 85/68* (2013.01); *B65D 81/36* (2013.01); *F04D 25/088* (2013.01); *F04D 29/601* (2013.01); *F04D 29/646* (2013.01); *F04D 29/263* (2013.01); *F05D 2230/68* (2013.01); *F05D 2260/02* (2013.01)

(58) Field of Classification Search
CPC ..... B65D 85/68; B65D 81/36; F04D 25/008; F04D 25/088
USPC ..... 206/319, 216, 223
See application file for complete search history.

(56) References Cited

U.S. PATENT DOCUMENTS 4,174,036 A * 11/1979 Beckman ..... B65D 81/022 206/223
4,640,419 A * 2/1987 Yang ..... B65D 71/00 206/320
4,828,115 A * 5/1989 Wiegand ..... B65D 81/113 206/319

(Continued)

FOREIGN PATENT DOCUMENTS

CA 2084480 A1 11/1993
CN 2284216 Y 6/1998

(Continued)

OTHER PUBLICATIONS

Chinese Office Action corresponding to Chinese Application No. 201810018485.5 dated Jun. 14, 2019.

*Primary Examiner* — Steven A. Reynolds
(74) *Attorney, Agent, or Firm* — McGarry Bair PC

(57) ABSTRACT

An apparatus and method for packaging and installing a ceiling fan. A bucket or a kit including a bucket can be used to store a ceiling fan. A lid can be used to cover the bucket. The lid can include opening portions that are removable to define an aperture in the lid. The ceiling fan can include a motor, a downrod, and a tri-lobe ball. The tri-lobe ball can be mounted to the motor via the downrod. The tri-lobe ball and the downrod can be inserted into the aperture in the lid to assist in assembling the ceiling fan.

27 Claims, 17 Drawing Sheets

(56) References Cited

U.S. PATENT DOCUMENTS

| | | | | | |
|---|---|---|---|---|---|
| 4,953,698 | A * | 9/1990 | Gregorich | B65D 85/68 | 206/319 |
| 5,337,892 | A * | 8/1994 | Zaffina | A01K 97/06 | 206/315.11 |
| 5,441,163 | A * | 8/1995 | Carrasco | B25H 3/00 | 206/373 |
| 5,779,045 | A * | 7/1998 | Yu | B65D 85/68 | 206/320 |
| 5,924,568 | A | 7/1999 | Zajonc | | |
| 5,938,276 | A | 8/1999 | Munoz et al. | | |
| 6,105,654 | A * | 8/2000 | Martel | F25D 23/069 | 16/225 |
| 7,431,056 | B1 * | 10/2008 | Smith | F16N 33/00 | 141/1 |
| 8,381,932 | B2 * | 2/2013 | Wagner | B65D 21/0209 | 206/430 |
| 8,992,111 | B2 | 3/2015 | Bachman et al. | | |
| 9,897,095 | B2 * | 2/2018 | Botkin | F04D 29/601 | |
| 2004/0149604 | A1 * | 8/2004 | Humphrey | B65D 85/68 | 206/320 |
| 2006/0032259 | A1 | 2/2006 | White | | |
| 2006/0076263 | A1 * | 4/2006 | Schafer | A47L 13/59 | 206/576 |
| 2009/0288969 | A1 * | 11/2009 | Winn | A63B 71/0045 | 206/315.1 |
| 2010/0043474 | A1 | 2/2010 | Strussion | | |

FOREIGN PATENT DOCUMENTS

| | | | |
|---|---|---|---|
| CN | 202054239 | U | 11/2011 |
| CN | 202747509 | U | 2/2013 |

* cited by examiner

PACKAGING APPARATUS AND METHOD FOR CEILING FAN

CROSS-REFERENCE TO RELATED APPLICATION(S)

This application claims priority to U.S. Provisional Patent Application No. 62/444,400, filed Jan. 10, 2017, which is incorporated herein by reference in its entirety.

BACKGROUND OF THE INVENTION

Packaged ceiling fans typically come in corrugated cardboard boxes. The packages include the disassembled ceiling fan components, typically divided into sections with foam or similar interior packaging materials. During manufacture and shipping, the foam content must be sufficient to protect the ceiling fan components in a stacked organization. As a result, a large volume of non-recyclable material is included with the typical ceiling fan purchase.

Additionally, after receiving of the packaged ceiling fan, all ceiling fan components are removed and the box and packing materials are traditionally discarded. There is no value to the box and packing materials aside from advertising in-store, and containing the ceiling fan during transport and sale.

BRIEF DESCRIPTION OF THE INVENTION

In one aspect, the disclosure relates to a kit for a ceiling fan including an electric motor having a motor shaft. The kit includes fan blades. The kit further includes a bucket having an interior and storing the electric motor and the fan blades. A lid removably mounts to the bucket and encloses the interior of the bucket. The lid includes opening portions wherein the opening portions are actuable to change the lid to an assembly platform.

In another aspect, the disclosure relates to a bucket for packaging a ceiling fan including a body defining an interior for the bucket. A lid removably mounts to the body and encloses the interior. The lid has opening portions where the opening portions are removable to adapt the lid for assembling the ceiling fan.

In yet another aspect, the disclosure relates to a method of supporting components for assembly of a ceiling fan packaged in a bucket with a lid including a motor assembly having a motor shaft, comprising supporting the motor assembly on an end of the bucket such that components of the ceiling fan can be mounted to the motor assembly.

DETAILED DESCRIPTION OF THE INVENTION

Aspects of the disclosure described herein are directed to a packaging for a ceiling fan in a bucket and a method of installing a ceiling fan. While the description will be directed toward a bucket, such as a 5-gallon bucket, and shown with respect to a particular ceiling fan, it should be understood that any bucket or ceiling fan can have similar or equal applicability. In some instances, a 5-gallon bucket is too small for a particular ceiling fan, and will necessarily need to be packaged in an alternative bucket-type package.

It should be further appreciated that the term "bucket" or "container" can be used interchangeably, as any suitable storing element for storing a packaged ceiling fan for shipping, storing, display, and sale. It should be further appreciated that the term "partition" or "divider" can be used interchangeable, as any suitable element for separating a portion of the bucket or container into a sub-portion, such as a chamber or a section.

Figure 1:
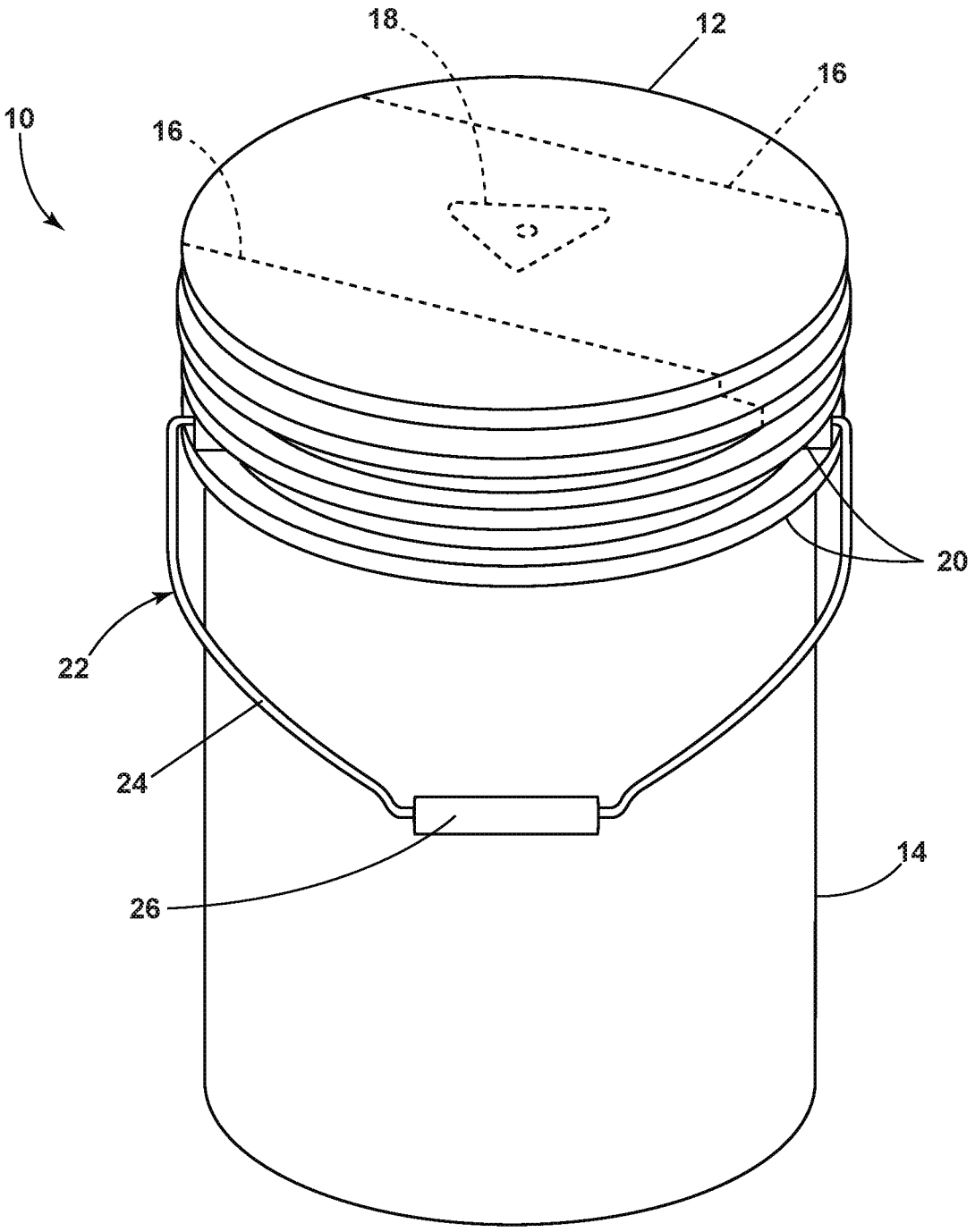
FIG. 1 is a top perspective view of a bucket having a lid with perforations.

Referring now to FIG. 1, a bucket 10 is shown as an exemplary 5-gallon bucket. The bucket 10 includes a lid 12 and a body 14. The lid 12 removably mounts to the body 14 for opening and closing the bucket 10. The lid 12 includes opening portions, illustrated as a pair of side opening portions 16 and a central opening portion 18. The opening portions 16, 18, can be perforated, for example, providing tearable removal by a user. Alternatively, the opening portions can be removably mounted, providing for removal and replacement after removal. Additionally, the opening portions can provide for selectively opening and closing, such as a hinged portion. It should be appreciated, that any opening portion is contemplated, such that the portions can be removed, actuated, opened, or otherwise affected to form an opening in the lid 12. The side opening portions 16 can be in different arrangements and are shown as parallel lines. The central opening portion can be of different shapes and is shown as a rounded triangle. The body 14 further includes a set of flanges 20 adjacent the lid 12. A handle 22 with a rod 24 and a grip 26 couples to the body 14 at the flanges 20. The handle 22 provides for lifting or moving of the bucket 10. It should be understood that the handle 22 is optional, and the bucket 10 can be provided without a handle 22.

Figure 2:
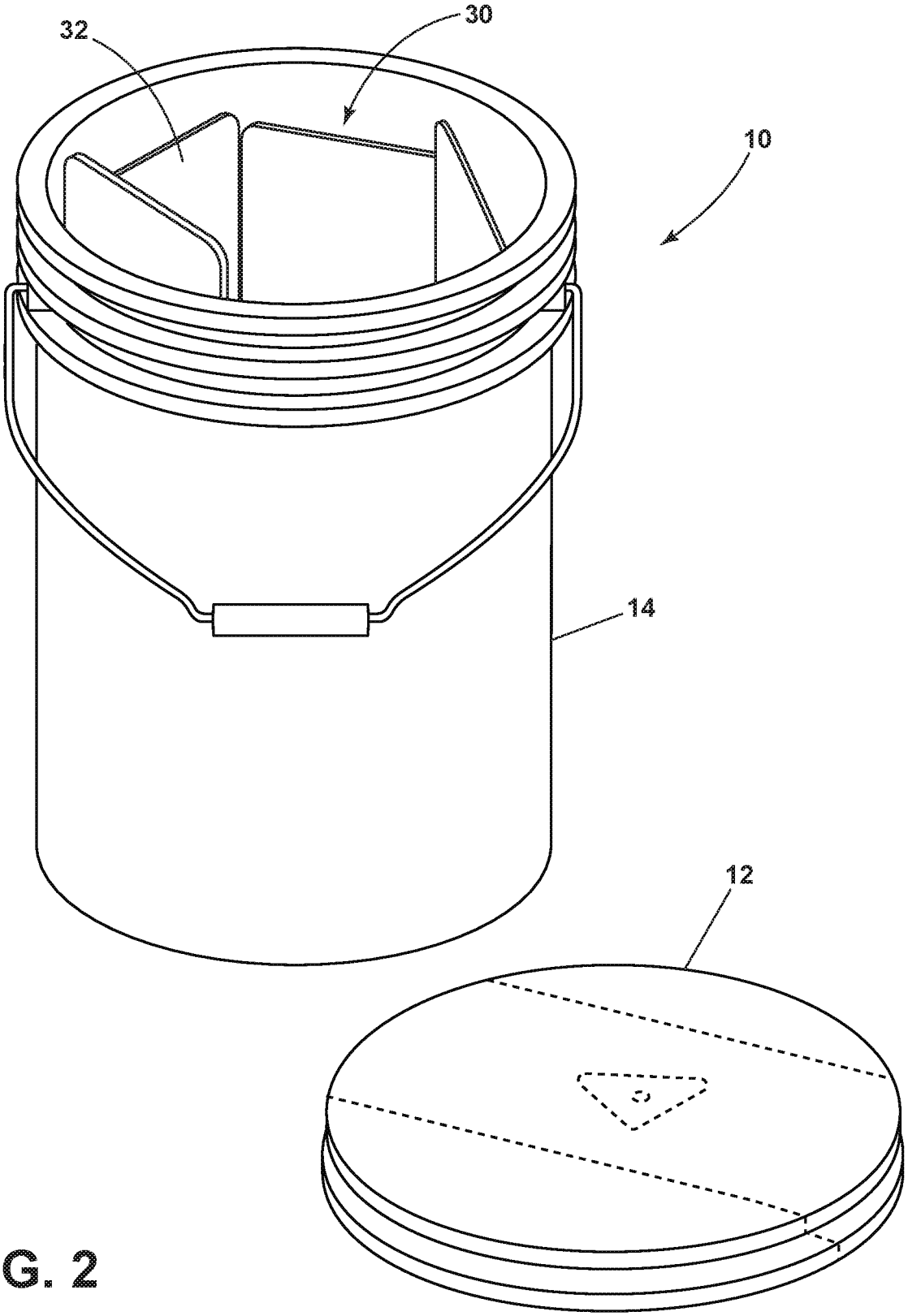
FIG. 2 is a top perspective view of the bucket of FIG. 1 with the lid removed.

FIG. 2 shows the bucket 10 having the lid 12 removed. The body 14 defines an interior 30 accessible upon removal of the lid 12. Fan components are visible within the interior 30 of the bucket 10. As visible in FIG. 2, of the multiple fan components in the bucket only five ceiling fan blades 32 are visible. It should be appreciated that additional fan components can be housed in the bucket 10, not visible in the view as shown and will be described in further detail in FIG. 3.

Figure 3:
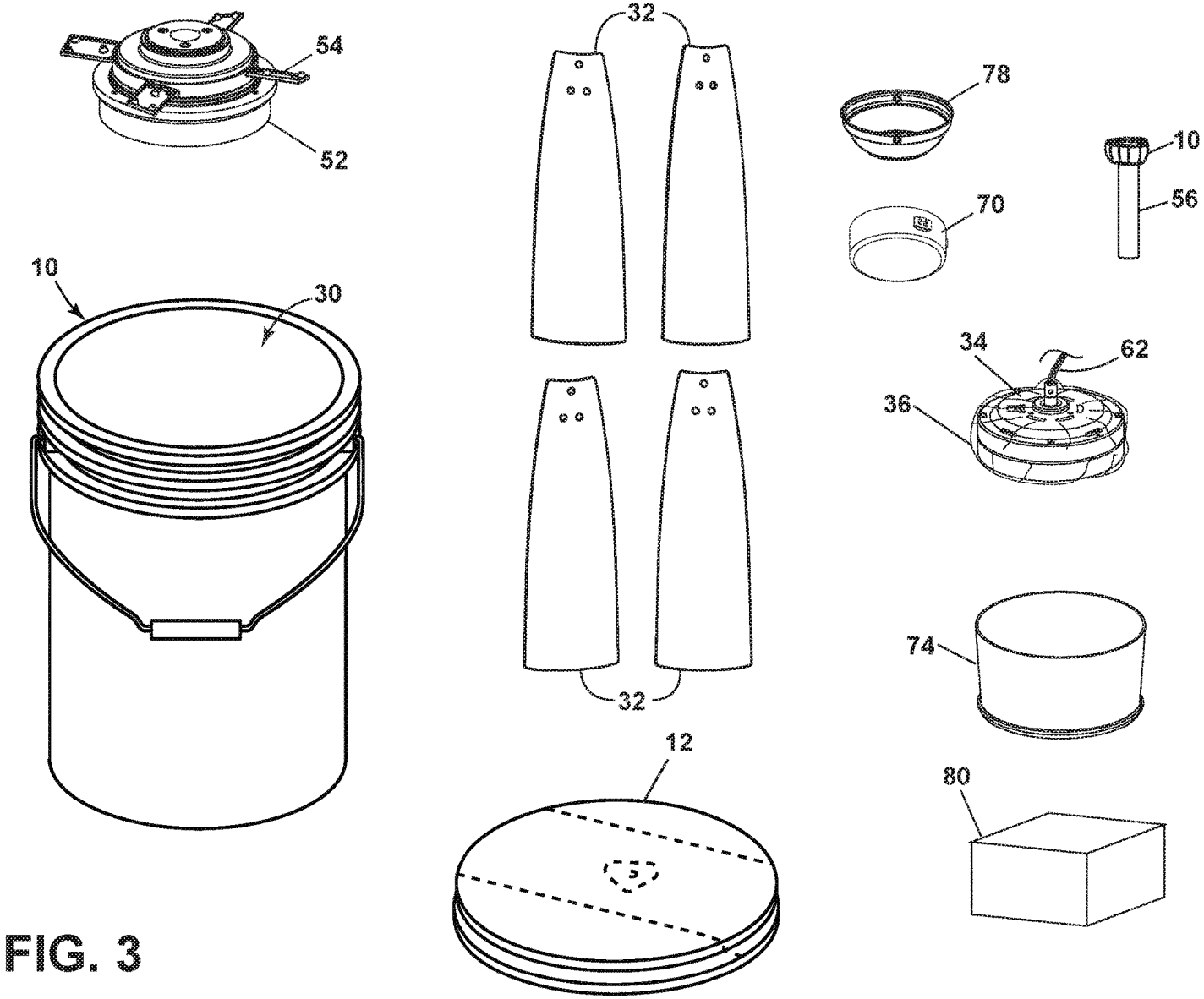
FIG. 3 is a top perspective view of the bucket of FIG. 2 with ceiling fan components removed from the bucket.

Referring to FIG. 3, ceiling fan components have been removed from the interior 30 of the bucket 10 for assembly. The blades 32 have been removed. As the blades 32 are a taller component, they can be removed first as access to the blades 32 is easy. A motor 34 is removed from the interior 30 and includes an outer wrapping 36 to protect the motor 34. Additional component removed from the interior 30 an include a motor housing 52, a set of blade irons 54, a downrod 56, a mounting ball illustrated as a tri-lobe ball 60, a wiring harness 62, a switch housing 70, a light kit 74, a canopy 78, and a box 80. The blade irons 54 are shown as attached to the motor housing 52. Some components can come preassembled, while other may require assembly. It should be appreciated that a ceiling fan as packaged in the bucket 10 is not limited to the components as shown, and can include more or less components. Such additional components can be packaged in the boxes 80, for example. Ceiling fan components can include but are not limited to blades, a motor, a motor housing, an upper motor housing, a lower motor housing, a switch housing, a light kit having one or more light kit components such as a light glass(es) or bulbs, blade irons, blade medallions, wiring, a motor coupler, a downrod, a ball mount, a lobed ball, or hanger bracket or similar mounting feature, as well as any mechanical components necessary to installation, such as screws, nuts, washers, tools or the like. It should be appreciated that a particular ceiling fan can have a multitude of ceiling fan components, which in combination form an assembled ceiling fan. Such components comprising the ceiling fan can be included within the interior of the bucket 10 in a disassembled fashion. Alternatively, some elements can be preassembled prior to packaging in the bucket 10, such as coupling the motor housing 52 to the motor 34.

Such components can be organized within the interior 30 of the bucket 10, as well as securely packaged. Such packaging can include foam packaging, air packaging such as bubble wrap, corrugated cardboard, or the like, as well as any necessary wrapping, such as the outer wrapping 36 for the motor 34.

It should be further appreciated that the bucket 10, lid 12, and any interior components can define a kit for a ceiling fan. The kit can include the components as shown, or any ceiling fan components including but not limited to, a canopy, a downrod, a ball mount such as a tri-lobe ball, a hanger bracket or similar bracket for suspending the ceiling fan from a structure, a motor coupler, a motor adapter, a motor including necessary components, a motor housing, blades, blade irons, blade medallions, a switch housing, a light kit or light glass, fasteners such as screws or nuts, tools, electrical wiring, instructions, or additional packaging for storing or securing components such as a box.

Figure 4:
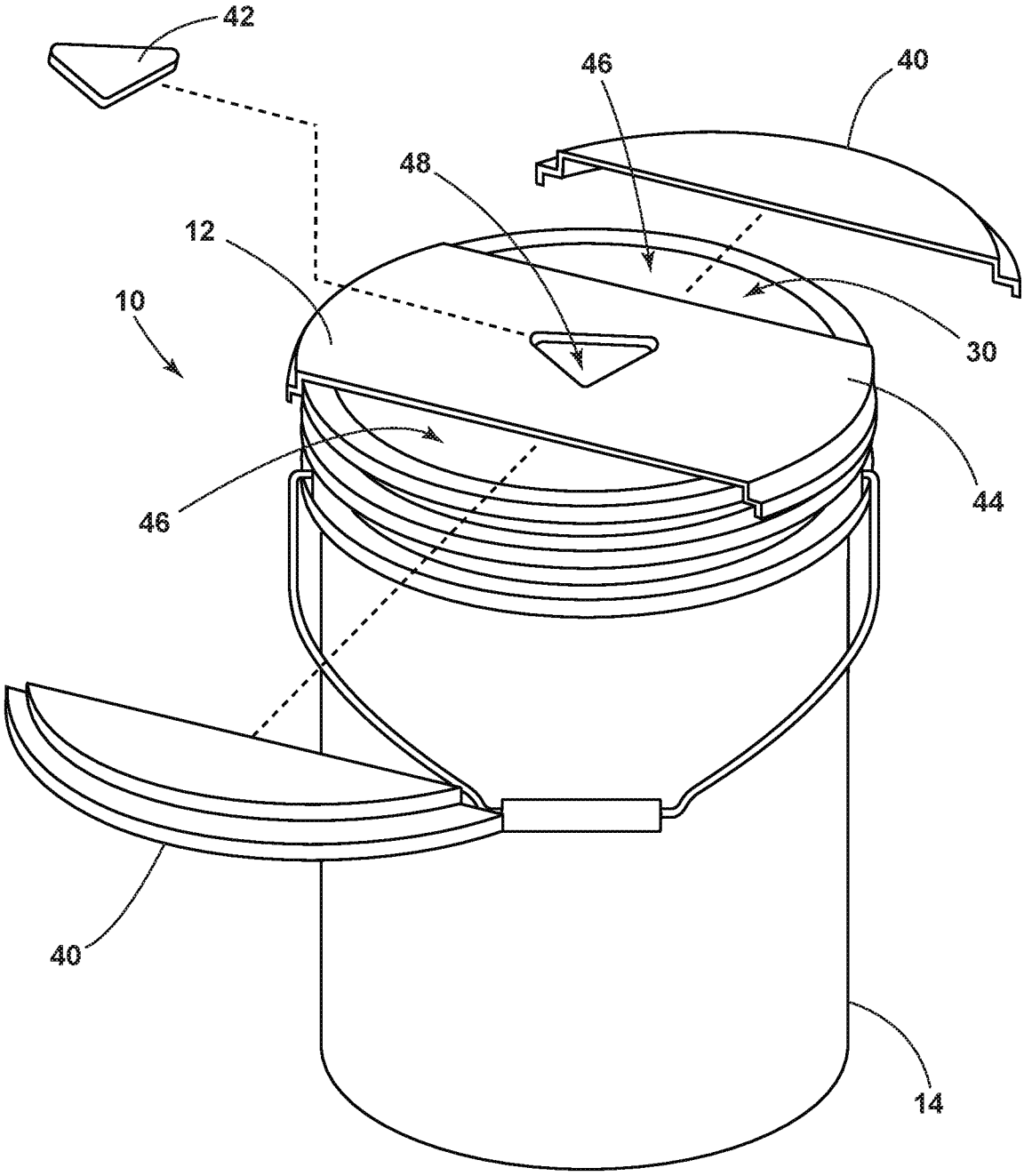
FIG. 4 is a top perspective view of the bucket with portions of the lid removed along the perforations of FIG. 1 to form apertures.

After removing all of the ceiling fan components included in the interior 30 of the bucket 10, the lid 12 reattaches to the top of the bucket 10 to enclose the interior 30. Referring now to FIG. 4, the lid 12 reattaches to the top of the body 14. Two side portions 40 of the lid 12 have been removed as well as a triangular portion 42. The side portions 40 and the triangular portion 42 can be removed along the opening portions 16, 18 of FIG. 1. Such removal can be accomplished by pulling or tearing the side portions 40 from the lid 12 or the top of the bucket 10. Removal of the triangular portion 42 can be accomplished by punching out the triangular portion 42, for example. Alternatively, the portions 40, 42 can be removed by any known method.

A shaped portion 44 of the lid 12 remains attached to the bucket 10. The shaped portion 44 defines two side apertures 46 and a triangular central aperture 48, respective of the removed side portions 40 and the triangular portion 42. While aspects described herein are directed toward the two side apertures 46 and the triangular central aperture 48, it should be appreciated that the lid 12 is not limited as shown and described.

Figure 5:
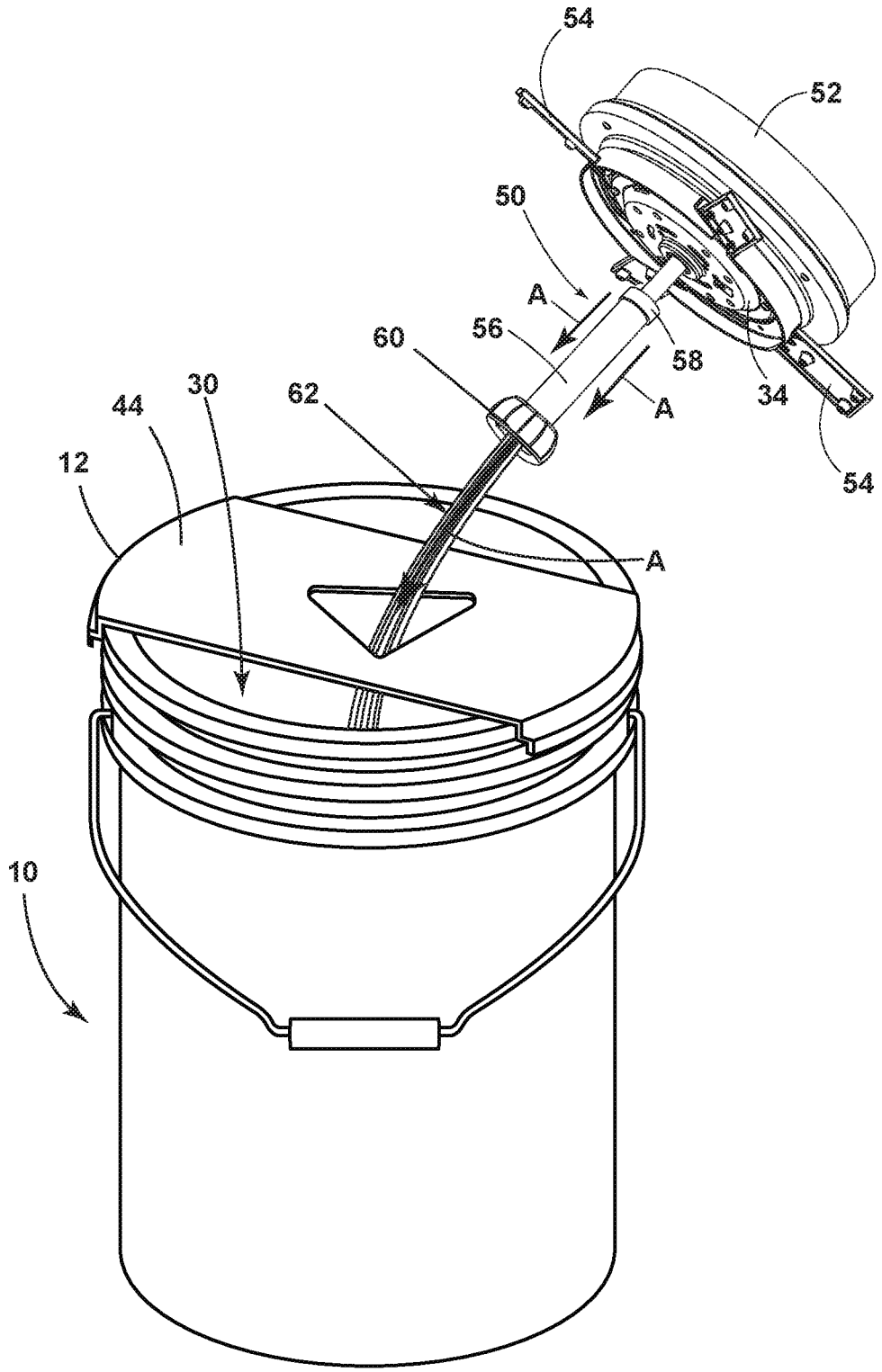
FIG. 5 is a top perspective view of the bucket of FIG. 4 illustrating insertion of a ceiling fan motor assembly into one aperture on the lid of the bucket.

The bucket 10 and the shaped portion 44 of the lid 12 can be used to assist in assembling and ultimately installing a ceiling fan. Referring now to FIG. 5, a ceiling fan motor assembly 50 can be assembled by a user initially including coupling the motor 34, the motor housing 52, blade irons 54, downrod 56, a motor coupler 58, and the tri-lobe ball 60. While a tri-lobe ball 60 is shown, it should be understood that any mount, or ball mount, can be utilized. A plurality of wires 62, which can be motor wires fixed to the motor 34, can electrically couple the motor 34 to a power supply. The ceiling fan motor assembly 50 can be assembled by coupling ceiling fan elements after removal from the bucket 10. Such components can be any components mounted to the top or upper portions of the motor 34, in one example.

Figure 7:
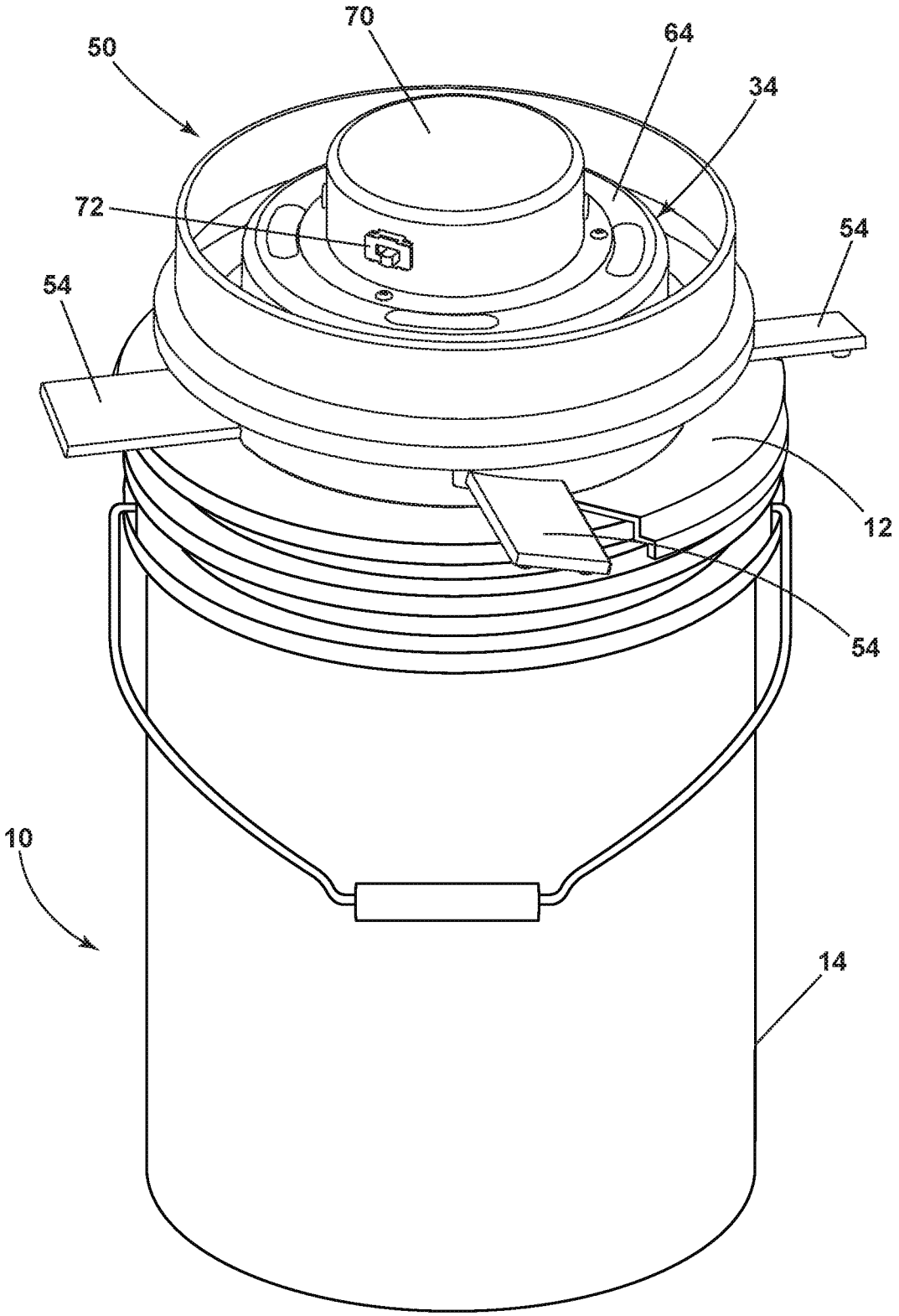
FIG. 7 is a top perspective view of the motor assembly of FIG. 6 with an attached switch housing.

The ceiling fan motor assembly 50 can be supported at the bucket 10 facilitating additional assembly of the ceiling fan motor assembly 50. The bucket 10 can support the ceiling fan motor assembly 50 by inserting the ceiling fan motor assembly 50 into the bucket 10 upside-down along arrows A. The triangular central aperture 48 can be shaped to accept the tri-lobe ball 60. FIG. 7 shows the ceiling fan motor assembly 50 resting on the lid 12 after insertion of the tri-lobe ball 60 and downrod 56 into the interior 30 of the bucket 10 through the triangular central aperture 48. The ceiling fan motor assembly 50 can rest upon the lid 12, with the tri-lobe ball 60, the downrod 56, and the motor coupler 58 hidden within the interior 30 of the bucket 10. The motor housing 52 and the blade irons 54 face the lid 12, with the motor housing 52 resting against the lid 12. An underside 64 of the motor 34 is exposed.

The side apertures 46 are also partially exposed with the ceiling fan motor assembly 50 resting on the bucket 10. The side apertures 46 can facilitate mounting additional ceiling fan components to the ceiling fan motor assembly 50 by providing additional space for working around the ceiling fan motor assembly 50.

It should be understood that the tri-lobe ball 60, downrod 56, motor coupler 58, motor 34, motor housing 52, and blade irons 54 are preassembled prior to insertion of the ceiling fan motor assembly 50 into the bucket 10 through the central aperture 48. Assembly of any components that would be hindered by insertion of the ceiling fan motor assembly 50 into the bucket 10 should be finished before insertion of the ceiling fan motor assembly 50 into the bucket 10. For example, as shown, assembly of the motor housing 52 would be difficult or impossible to install after insertion of the downrod 56 into the interior 30. As such, any necessary assembly can be accomplished prior to insertion. Alternatively, the motor housing 52 or other such components can be preassembled to the motor 34 such that a consumer does not have to perform any preassembly and can insert the ceiling fan motor assembly directly into the bucket 10. However, any preassembly of the ceiling fan motor assembly 50 can be limited by the size of the bucket 10. For example, ceiling fan blades 32 cannot be preassembled to the motor 34 and still fit in the bucket 10. As such, it should be understood that any component may or may not be pre-assembled within the bucket as is desirable to the particular ceiling fan 10.

Referring now to FIG. 7, assembly of the ceiling fan motor assembly 50 can be continued by adding additional components to the ceiling fan motor assembly 50, facilitated by resting the ceiling fan motor assembly 50 on the bucket 10. As shown, a switch housing 70, having a switch 72 can mount to the underside 64 of the motor 34. It should be appreciated that while the blade irons 54 are shown as mounted to the upper area of the motor 34, some ceiling fans have blade irons that mount to the underside 64. As such, the blade irons 54 could mount to the underside 64 of the motor 34, at a rotor for example, prior to mounting of the switch housing 70 on the underside 64.

Figure 8:
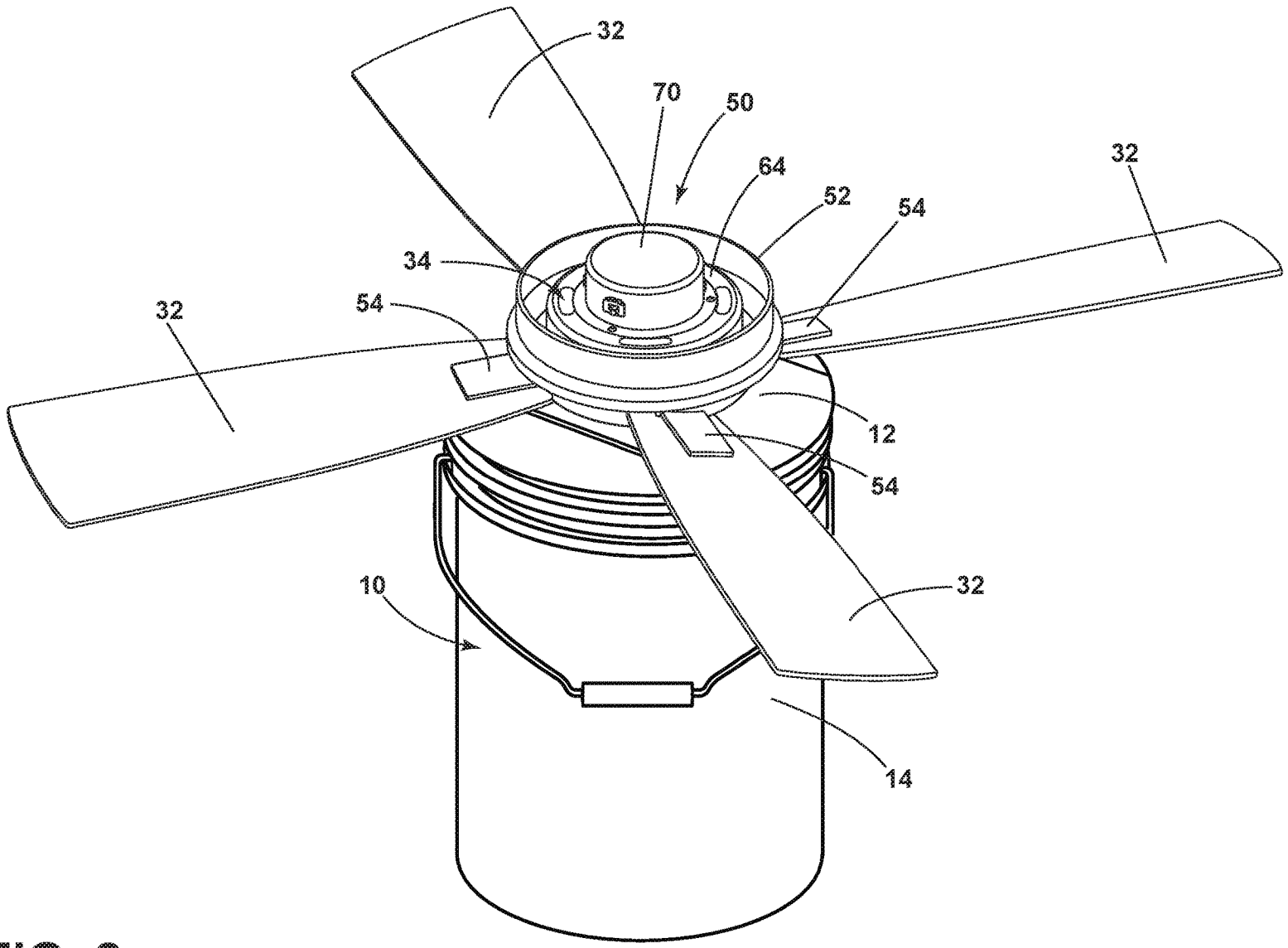
FIG. 8 is a top perspective view of the motor assembly of FIG. 7 with four attached blades.
Figure 9:
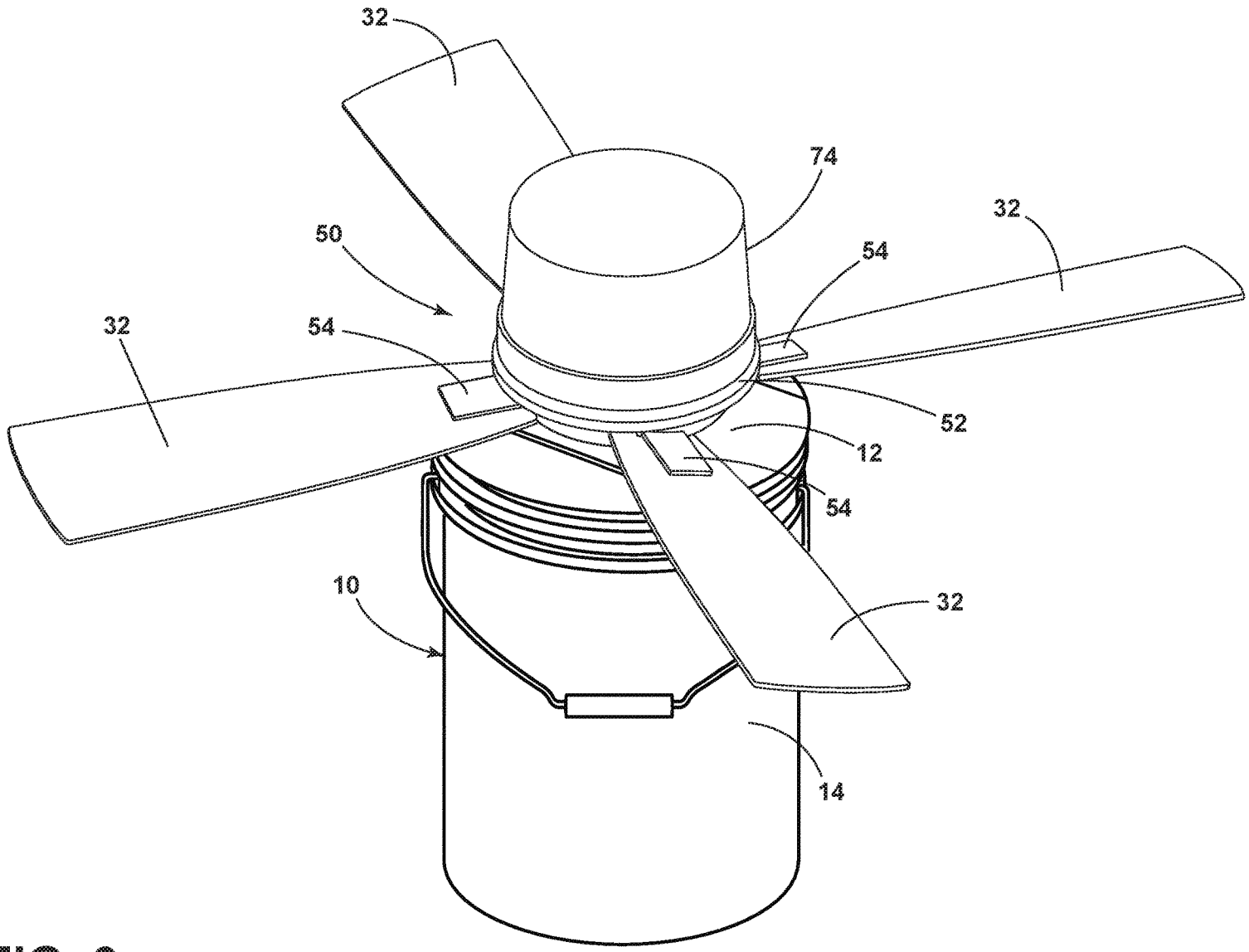
FIG. 9 is a top perspective view of the motor of assembly of FIG. 8 with the switch housing replaced with a light kit.

Referring now to FIG. 8, the blades 32 can mount to the ceiling fan motor assembly 50 at the blade irons 54. After mounting the blades 32, a bottom portion of the motor housing can be optionally added to cover the remaining exposed portions of the underside 64 of the motor 34. Alternatively, now referring to FIG. 9, the exposed underside 64 can also be used to attach a light kit 74 as opposed to a switch housing 70, or even to cover the switch housing 70. Typically, a ceiling fan will have a switch housing when it does not have a light kit. When the fan includes a light kit 74, the switch can be integrated into the light kit, or provided on the motor housing 52.

Figure 10:
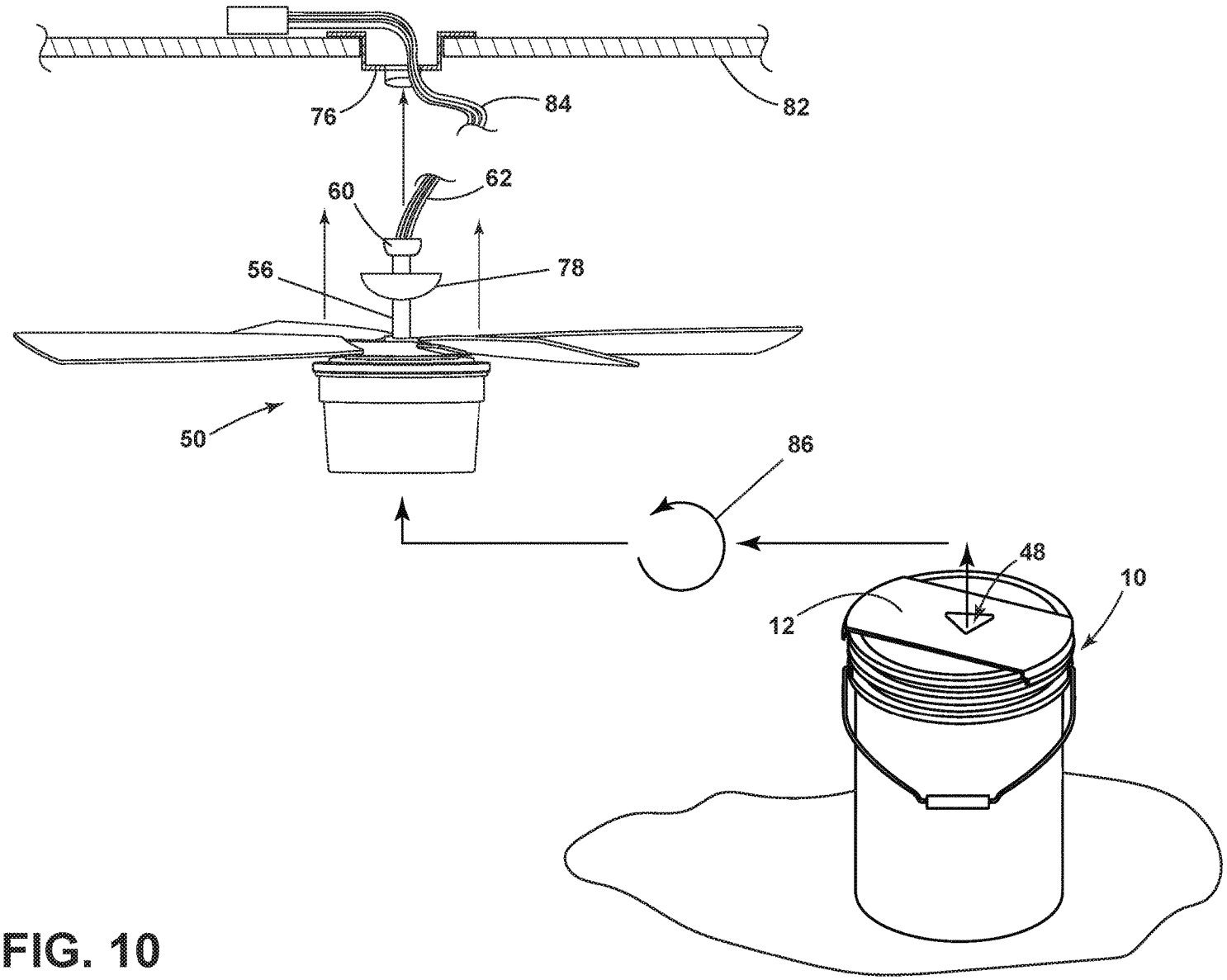
FIG. 10 is a schematic view of the motor assembly of FIG. 9 removed from the bucket for installation.

Referring now to FIG. 10, after completion of the ceiling fan motor assembly 50, the entire ceiling fan motor assembly 50 can be removed from the bucket 10, by sliding the downrod 56 and the tri-lobe ball 60 out of the central aperture 48. After removal, the ceiling fan motor assembly 50 rotates to be upright, as shown at arrow 86. The complete fan motor assembly 50 can be installed at a ceiling 82, such as by hanging the tri-lobe ball 60 at a hanger bracket 76. After hanging the ceiling fan motor assembly 50 on the hanger bracket 76, the wires 62 connect to a housing wiring 84 providing electrical power to the ceiling fan motor assembly 50. After final mounting and electrical connection, the canopy 78 can be slid up the downrod 56 and mounted to the hanger bracket 76 to hide the hanger bracket 76 from view.

After mounting of the ceiling fan motor assembly 50, the bucket 10 with the lid 12 remains. The consumer can use the bucket 10 after installation of the ceiling fan motor assembly 50, as opposed to disposing of the packing typical with ceiling fan packing, such as discarding cardboard and foam. A consumer can use the bucket 10, such as for storage or any other usage appropriate for a bucket 10. Additionally, in one non-limiting example, the bucket 10 and lid 12 can be made of No. 2 recyclable plastic, so a consumer can choose to properly recycle the bucket 10 as opposed to disposing of it in the trash.

Figure 11A:
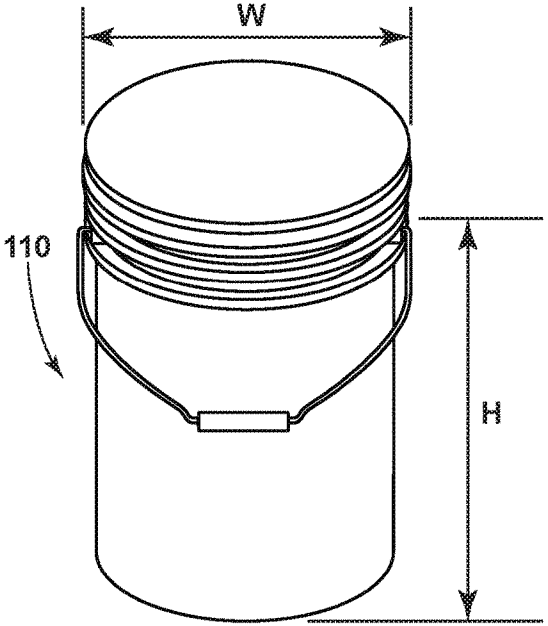
FIG. 11A is a top perspective view of a bucket illustrating a height and a width for the bucket.

Referring now to FIG. 11A, a bucket 110 can include a height H and a width W. The width W can be a diameter for the particular bucket 110 and can be used to calculate a volume for the bucket 110 with the height H. The volume can be used to ensure that there is sufficient space for the components for a ceiling fan motor assembly. Additionally, the blades of a ceiling fan can stand up between the bottom and the top of the bucket 110. As such, the height H of the bucket 110 needs to be sufficient to hold the length of the blades. It should be understood that the height H and the width W of the particular bucket 110 can be adapted to hold the particular ceiling fan. Larger fans necessarily require large buckets. As such, a 5-gallon bucket is not large enough to carry all fans.

Figure 11B:
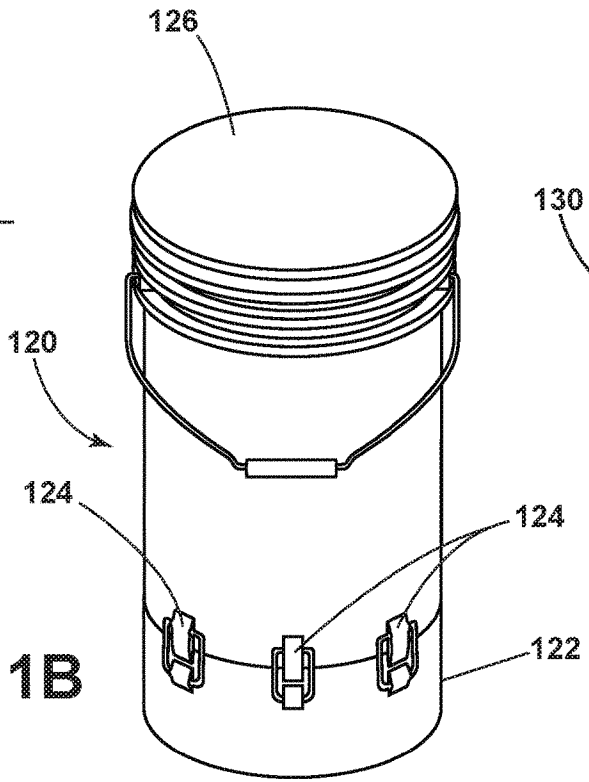
FIG. 11B is a top perspective view of another bucket including latches coupling the bucket to an additional compartment.

Referring now to FIG. 11B, a bucket 120 can include an attached compartment 122. The compartment 122, as shown, attaches by latches 124 and is attached to the bottom of the bucket 120. It should be understood that the attached compartment 122 can attach by any means and to any portion of the bucket 120. For example, the compartment 122 can attach on top of a lid 126 of the bucket 120, and can attach with an adhesive such as glue or tape. In another example, the attached compartment can attach to the side of the bucket 120, and can remain in place by a stretch-wrapping material. The attached compartment 122 can also be another bucket.

The compartment 122 can be dedicated to a particular component of the ceiling fan. For example, as shown, the latched compartment 122 can hold a motor. As the motor can be a sensitive component, the packaging of the compartment can be tailored to the motor, including additional packaging materials or include thicker walls to protect the motor. Additionally, where the compartment 122 attaches to the bottom of the bucket 120, it bears a greater amount of weight, especially if multiple buckets are stacked on one another. The compartment 122 can be adapted to have increased structural integrity anticipating the additional weight.

Figure 11C:
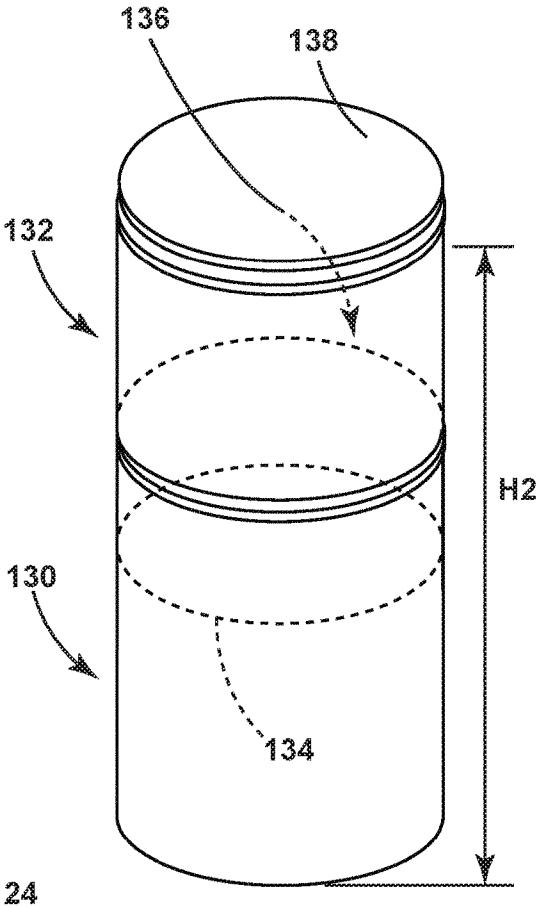
FIG. 11C is a top perspective view of yet another bucket including two combined buckets to have an increased height.

Referring now to FIG. 11C, a bucket 130 is shown coupled to a second bucket 132, having an increased height H2. The bucket 130 can be a standard bucket, such as a 5-gallon bucket. The second bucket 132 can have a bottom 134 removed, connecting the interiors of the buckets 130, 132 into a single interior space 136. The lid 138 can attach to the second bucket 132 to enclose the interior space 136. The buckets 130, 132 can attach to one another by any means, such as gluing, melting, or wrapping, in non-limiting examples. Some ceiling fans require long blades, often in 3 feet in length or greater, which is longer than the height of the typical 5-gallon bucket. In a case where the ceiling fan has elongated blades, a bucket with an extended height H2 will be required to house the blades. It should be appreciated that the buckets 130, 132 can have different cross-sectional shapes, such as squared, rounded, or geometric in non-limiting examples.

It should be appreciated that FIGS. 11A-11C illustrate two different ways to increase the height or volume of bucket. It should be further appreciated that the bucket can be initially formed having height H and width W sufficient to house the necessary ceiling fan components. Such a bucket could be molded, such as by blow molding. FIGS. 11B and 11C illustrate two potential ways to increase bucket capacity without creating an initially larger bucket and provide options for storing or holding ceiling fan components in a particular manner.

Figure 12B:
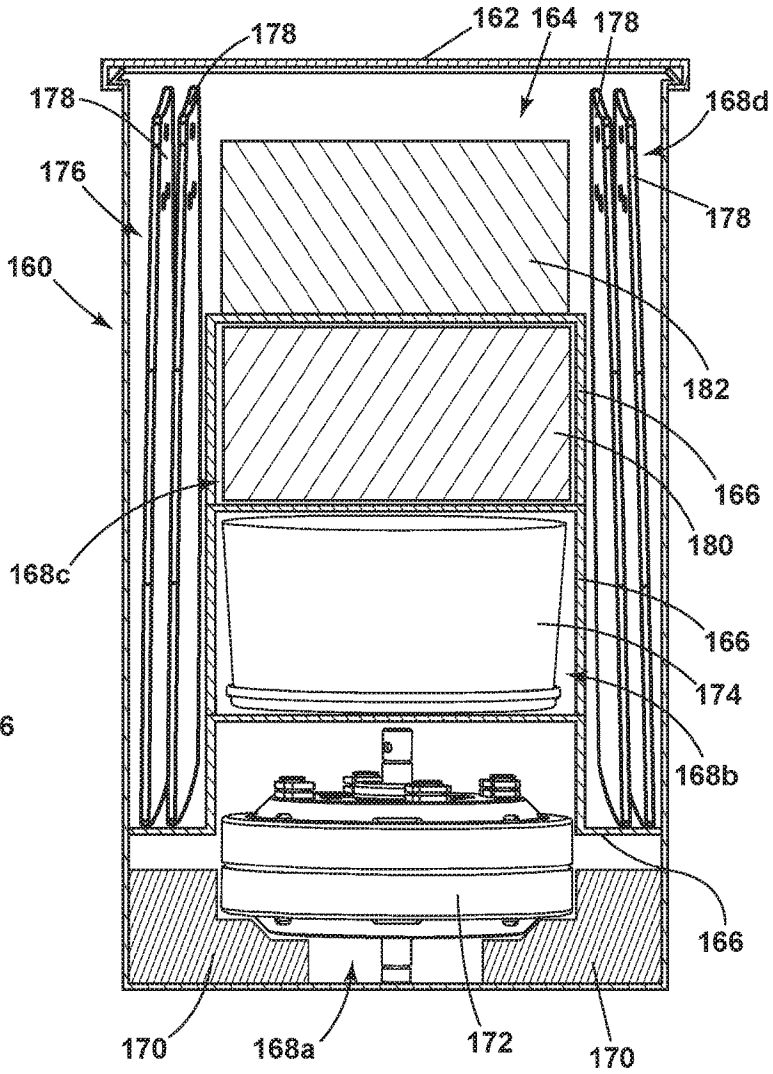
FIG. 12B is another cross-sectional view of another bucket being partitioned and illustrating one exemplary organization of ceiling fan components in the interior of the bucket.
Figure 12A:
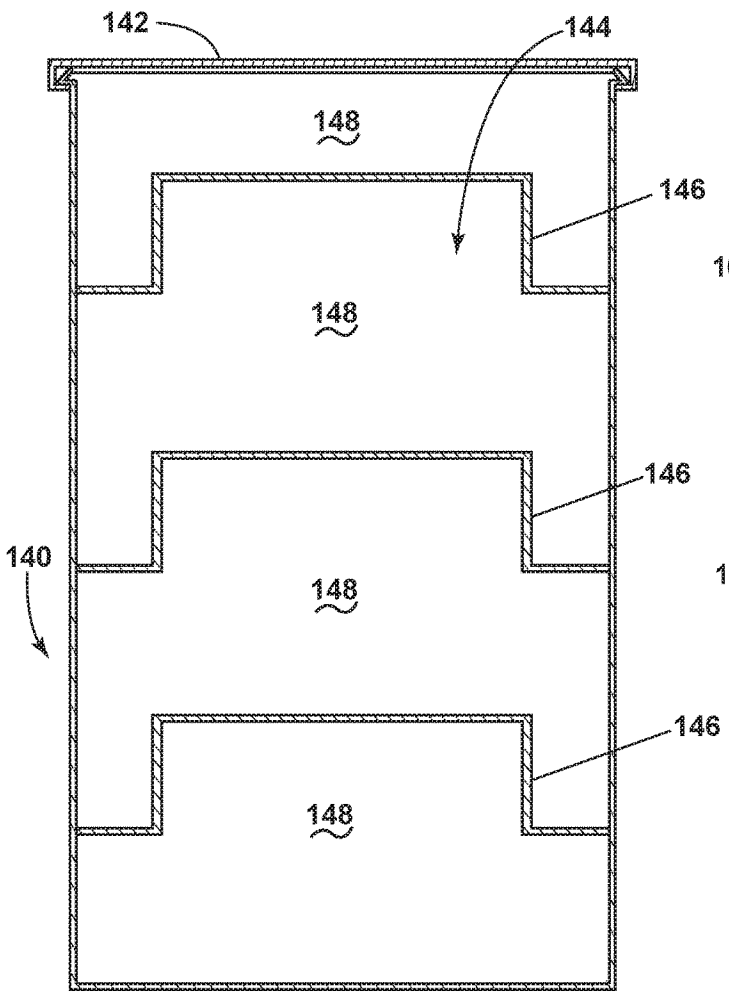
FIG. 12A is a cross-sectional view of another bucket illustrating an interior that has been divided by partitions.

Referring now to FIG. 12A, a section view of a bucket 140 with a lid 142 illustrates an interior 144 of the bucket 140. Three partitions 146 are provided in the interior 144 separating the interior 144 into four chambers 148. The particular chambers 148 can be used to house individual components of the ceiling fan as well as protecting such components from damage. For example, the fan blades can be arranged around the motor housing. In another example, the motor housing can be provided at the bottom of the bucket. Providing the motor housing at the bottom of the bucket can give the packaged bucket a low center of gravity, preventing tipping. In yet another example, the blades can be providing in a different chamber than the motor, or a light kit can be provided in a different chamber than the motor. The partitions 146 can be made of any sufficient material, such as cardboard or foam. A recyclable foam such as expanded polystyrene can be utilized. The partitions assist in organized packaging of the ceiling fan, as well as prevent movement and damage to the ceiling fan components during moving, shipping, transport, sale, or display.

Referring now to FIG. 12B, an exemplary organization of a section view of another bucket 160 with a lid 162, including partitions 166 separating an interior 164 of the bucket 160 into a first chamber 168*a*, a second chamber 168*b*, a third chamber 168*c*, and a fourth chamber 168*d*. The first chamber 168*a* includes an annular foam portion 170 supporting a motor 172. Depending on the size of the motor 172, the motor 172 can include an attached motor housing, or other preassembled elements. Ceiling fan components such as the motor 172, light kit 174, and blades 178 are not shown in cross section for ease of identification.

The second chamber 168*b* includes the light kit 174. Additional packaging can be included around the light kit 174 to prevent damage. However, with the bucket structure and partitions, such packaging is minimized as compared to traditional ceiling fan packaging. The additional protection provided by the bucket 160 minimized the required packaging protection within the bucket 160.

The third chamber 168*c* includes a first boxed package 180, which can hold several smaller components, such as blade irons, a canopy, screws, nuts, or tools in non-limiting examples. The fourth chamber 168*d* is defined by the bucket 160 and the partitions 166 defining the other chambers 168*a-c*, defining elongated side portions 176 of the fourth chamber 168*d*. Fan blades 178 can be provided in the elongated side portions 176, for example. Additionally a second boxed package 182 can be provided in the fourth chamber 168*d* for holding additional components, such as a motor housing, canopy, downrod, motor coupler, motor rod, blade irons, switch housing, hanger bracket, tri-lobe ball, or other light kit components in non-limiting examples.

The boxed packages 180, 182 are advantageous for holding smaller components or parts, which might otherwise fall to the bottom of the bucket or become lost. However, it is contemplated that the buckets as described herein require no interior packaging.

Figure 14A:
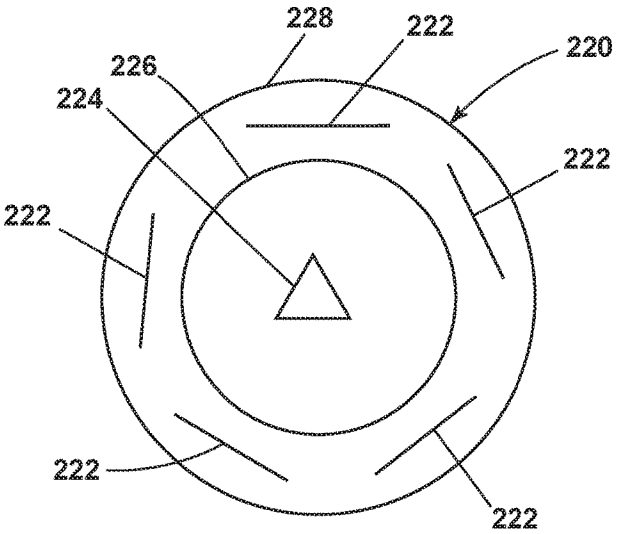
FIG. 14A is a top view of an exemplary organization for a ceiling fan in a cylindrical bucket.
Figure 14B:
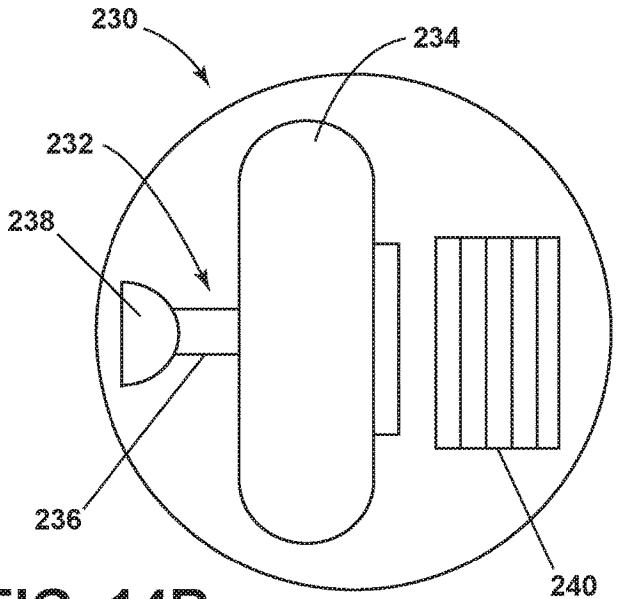
FIG. 14B is a top view of another exemplary organization for a ceiling fan in a cylindrical bucket.

It should be understood that that partitions forming the chambers in FIGS. 12A and 12B are exemplary and any components provided within the chambers 168*a-d* of FIG. 14B are by way of example only. The particular organization of a bucket, interior partitions or packaging, or otherwise can be particular to a particular ceiling fan design, and should not be limited by what is shown in FIGS. 12A-12B.

Figure 13C:
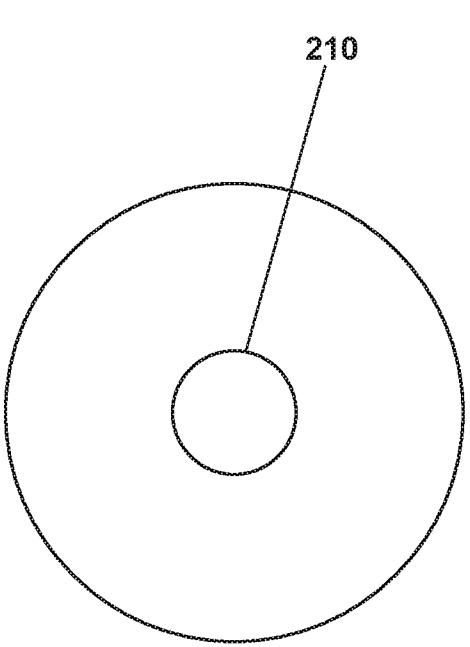
FIGS. 13A-13C illustrate three different exemplary lids for a bucket.
Figure 13B:
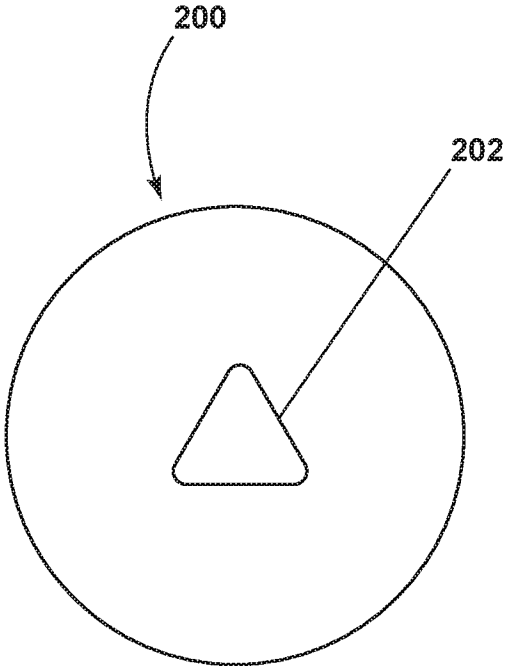
Figure 13A:
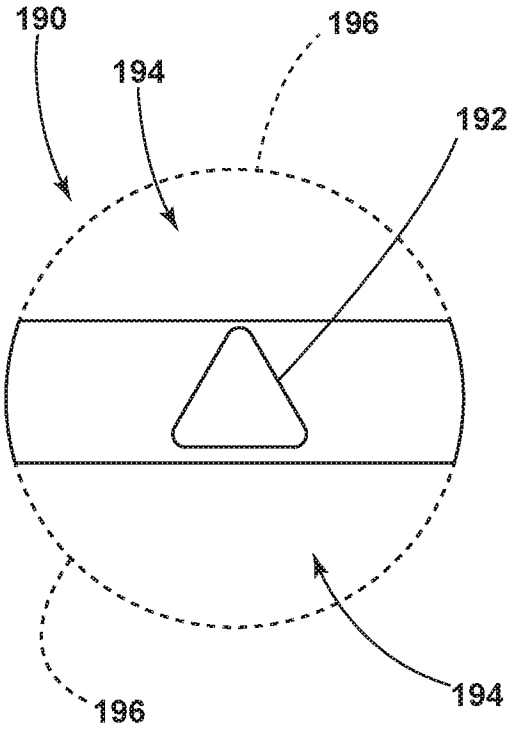

Referring now to FIG. 13A-13C, three exemplary lids for a bucket are illustrated having portions removed. Referring to FIG. 13A, a first lid 190 can be substantially similar to the lid 12 of FIGS. 1-10. The lid 190, having perforated portions removed therefrom, includes a triangular central aperture 192 adapted to receive an inserted tri-lobe ball, such as the tri-lobe ball 60 of FIG. 6, for example. Side apertures 194 are formed with the removal of side portions 196 of the lid 190. The side apertures 194 provide access to an interior of the lid 190 after a ceiling fan assembly inserts into the lid 190 through the triangular aperture 192.

Referring now to FIG. 13B, another lid 200 has a triangular aperture 202 without any side opening portions as compared to FIG. 13A. Removing the side opening portions maintains the integrity of the lid 200 after usage for assembly and installation of the ceiling fan. Referring now to FIG. 13C, a central aperture 210 can have additional shapes, illustrated as a circle. The central aperture 210 should not be limited as shown, and can have any shape, such as a square or rectangle in additional non-limiting examples.

It should be further appreciated that the opening portions and apertures formed by removal of portions of the lid are not limited as shown. The opening portions can have any organization for forming apertures to facilitate assembly and installation of a ceiling fan.

Additionally, it should be appreciated that the apertures need not be formed by removal of perforated portions of the lid. The apertures in the lid can be formed by removably attachable portions that can be selectively removed and replaced after assembly and installation of the ceiling fan. One non-limiting example can include a friction fit, where a central member can be selectively removed and inserted at the central aperture by pushing or pulling the central member in or out of the lid.

Furthermore, is should be appreciated that the motor assembly need not be installed on a lid, but can be installed on an end of a bucket. For example, rather than having opening portions provided in the lid, the opening portions can be provided on the underside of the bucket. As such, the bucket can be inverted and place on the lid or top of the bucket and a user can install the ceiling fan using the underside of the bucket. In such an example, the lid need not be transformable for supporting the ceiling fan assembly for assembly, and can be intact for usage of the bucket after installation of the ceiling fan. Similarly, the other end of the bucket at the top of the bucket can be adapted to support the ceiling fan assembly for assembly of the ceiling fan. Specifically, the structure of the bucket can include a portion similar to that of the lid 12 of FIG. 14 remaining attached to the bucket. Such a portion can be removably mounted to the bucket at the top end facilitating removal of the ceiling fan components from the bucket prior to assembly. In such an example, the bottom end and the lid can remain intact for usage of the bucket after assembly and installation of the ceiling fan. Thus it should be appreciated that an end of the bucket can be used for supporting the ceiling fan for assembly and is not limited solely to a lid enclosing the bucket.

Referring now to FIGS. 14A-14D, four different top views are shown of additional exemplary buckets illustrating different storage examples for packaging a ceiling fan into a bucket. Referring to FIG. 14A in particular, a cylindrical bucket 220 having a circular profile is illustrated. A set of fan blades 222 can be arranged evenly about the exterior of the bucket, with a central aperture 224 provided in a portion of the lid 226. As shown, the lid 226 does not extend to the edges 228 of the bucket 220, which can provide additional structural integrity, for example. Other components are stored between the blades 222 and stacked within the bucket 220 underneath the lid 226.

Referring now to FIG. 14B, a cylindrical bucket 230 having a circular profile can includes a motor assembly 232 including a motor 234, a downrod 236, and a mounting ball 238, such as a tri-lobe ball and a set of blades 240. The motor assembly 232 can be preassembled and oriented on its side, with the blades 240 provided on the opposite side of the bucket 230. A partition, for example, can be provided on top of the motor assembly 232 and additional components can be stacked on top of the motor assembly 232.

Figure 14C:
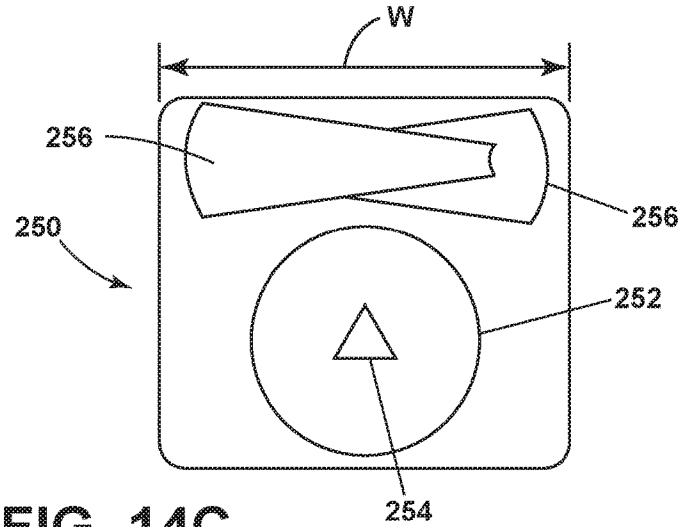
FIG. 14C is another top view of an exemplary organization for a ceiling fan in a squared bucket.

Referring now to FIG. 14C, a bucket 250 can have a rounded rectangular or rounded square shape. Alternatively, the bucket 250 need not be rounded. The width W of the bucket 250 can be of a size sufficient to hold the blades 256 in a flat manner or a slightly angled orientation between the top and bottom of the bucket. A lid 252 can include an aperture 254 with a triangular shape to assist in assembling a ceiling fan after removal of the components of the ceiling fan.

Figure 14D:
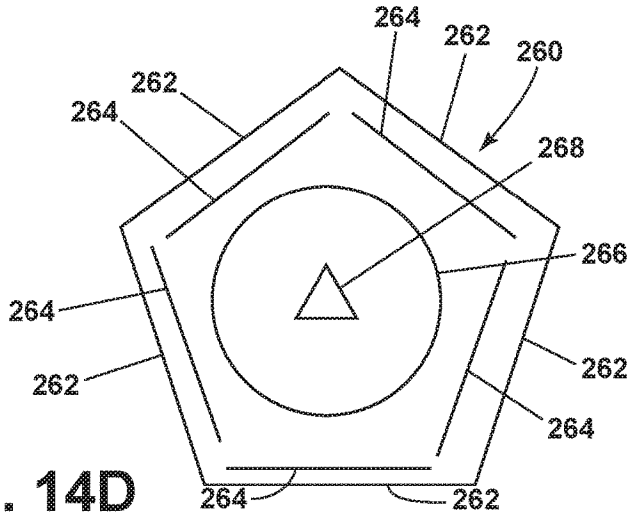
FIG. 14D is yet another top view of another exemplary organization for a ceiling fan in a pentagonal bucket.

Referring now to FIG. 14D a bucket 260 can have a pentagonal shape having five walls 262. A set of five blades 264, for example, is organized with one blade 264 against each wall 262, with space in the center of the bucket 260 remaining for additional components. The blades 264 can attach to the walls 262, such as with an adhesive, to minimize or prevent damage to the blades 264, protected by the rigid walls 262 of the bucket. A lid 266 can be provided on the bucket 260 for accessing the interior of the bucket 260. A central aperture 268 can be formed in the lid 266 for assisting in assembly and installation of the ceiling fan.

Figure 15:
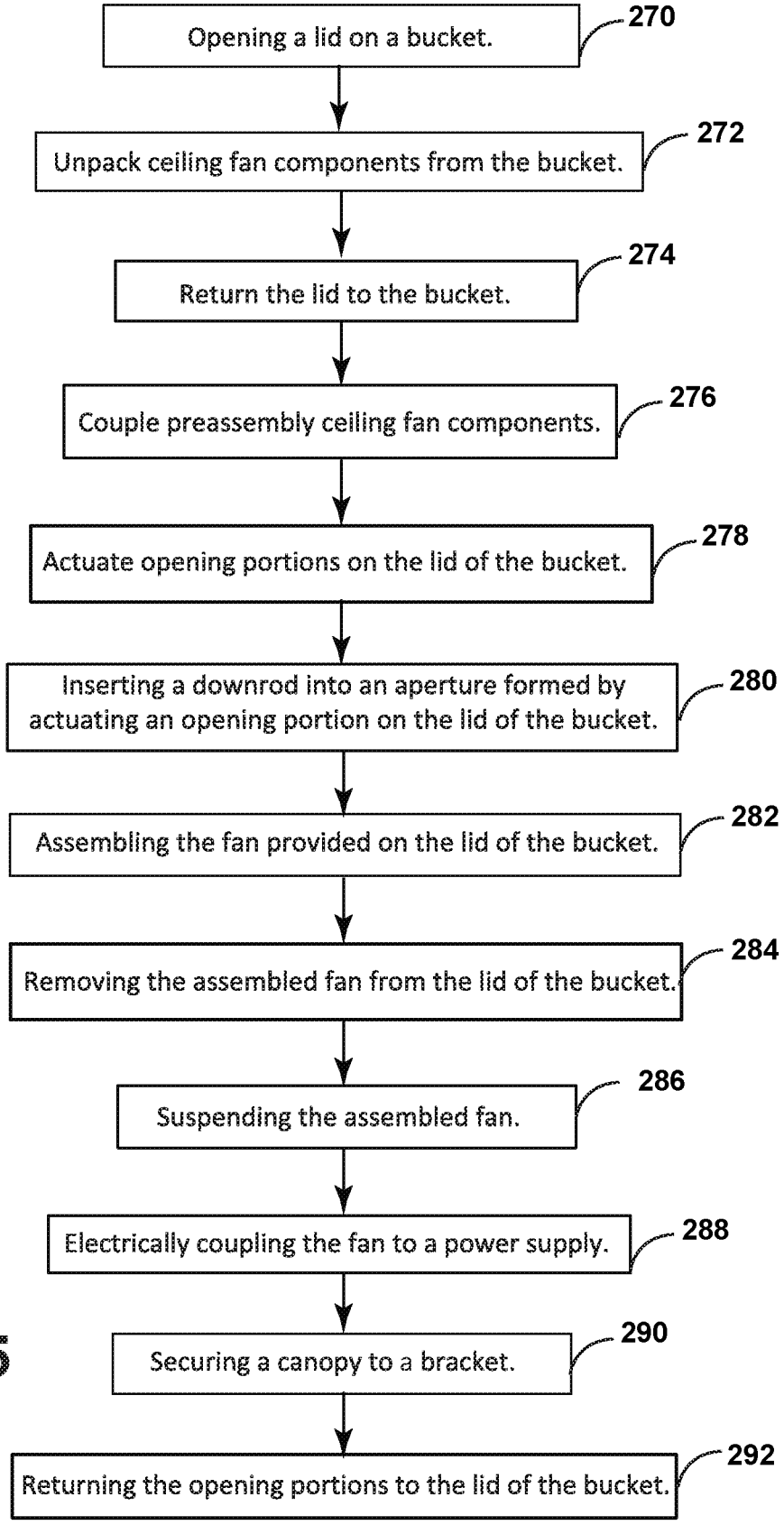
FIG. 15 is a flow chart illustrating a method of assembling a ceiling fan according to aspects described herein.

Referring now to FIG. 15, another method of assembling a ceiling fan packaged in a bucket can include: (1) opening a lid on the bucket, (2) unpacking ceiling fan components from the bucket, (3) returning the lid to the bucket, (4) coupling preassembly ceiling fan components, (5) actuating opening portions on the lid of the bucket, (6) inserting a downrod into an aperture formed by actuating an opening portion on the lid of the bucket, (7) assembling the fan provided on the lid of the bucket, (8) removing the assembled fan from the lid of the bucket, (9) suspending the assembled fan, (10) electrically coupling the fan to a power supply, (11) securing a canopy to the bracket, and (12) returning the opening portions to the lid of the bucket. It should be understood that the steps of the method can be performed in any order suitable for assembling the ceiling fan.

Step (1), at 270, opening a lid on the bucket can be performed by a user removing the lid, such as that shown in FIG. 2. Step (2), at 272, unpacking the ceiling fan can include removing the contents the bucket, such as a plurality of ceiling fan components stored in the bucket during shipping, sale, or otherwise. See FIG. 3, for example. After unpacking the bucket, the lid can be returned to the bucket at step (3) 274. Step (4), at 276, some of the components of the ceiling fan may need to be preassembled. For example, a downrod can be coupled to a motor shaft, and a ball can couple to the downrod opposite of the motor shaft, to form a fan assembly, such as that of FIG. 5. It should be appreciated that the fan assembly completed during preassembly is not limited as shown in FIG. 5, and can include any number of elements desirable to preassemble to the fan assembly prior to step (6), 280. For example, such elements can include, a downrod, motor coupler, motor adapter, motor housing, canopy, or ball mount in non-limiting examples.

Figure 6:
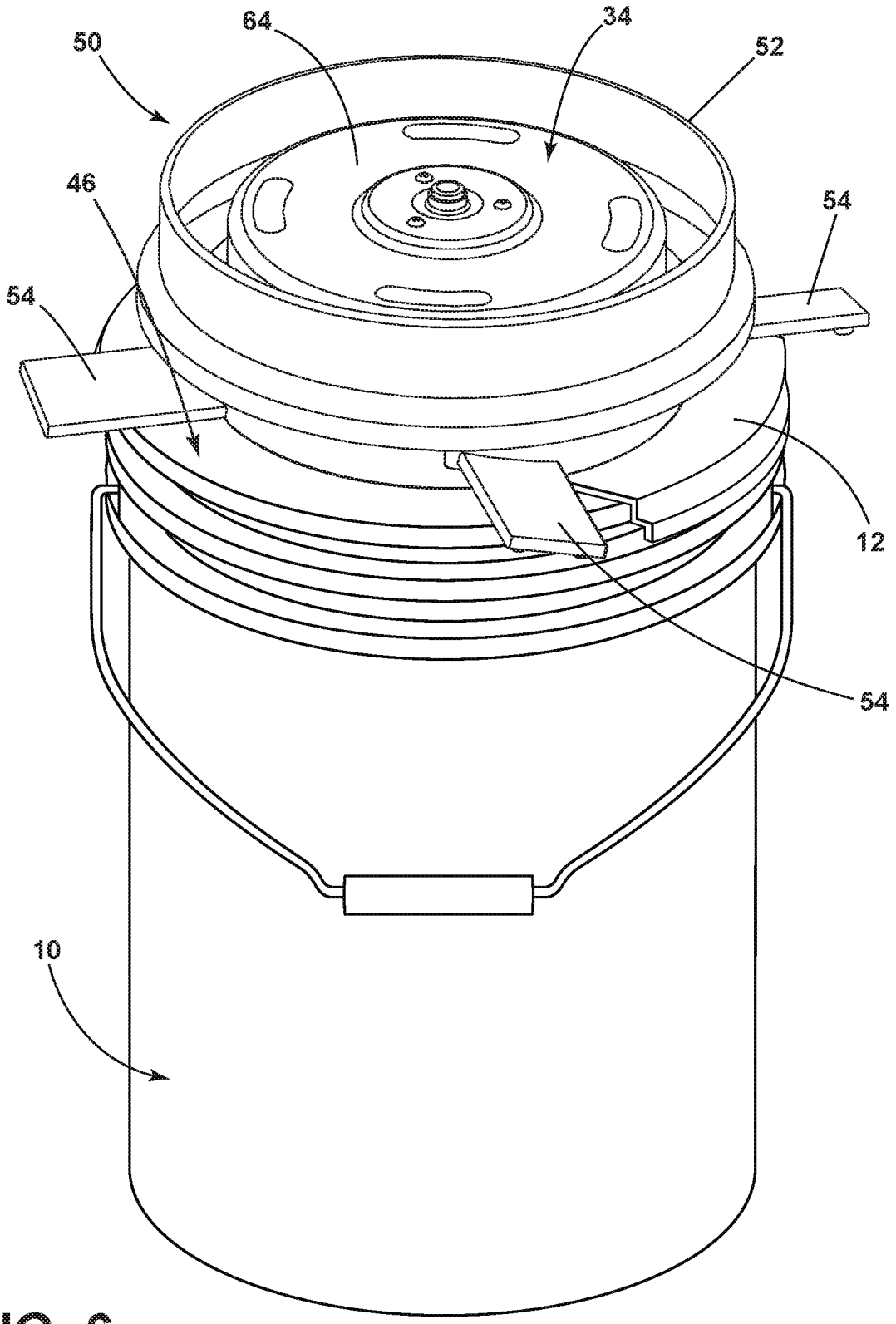
FIG. 6 is a top perspective view of the ceiling fan motor assembly of FIG. 5 inserted into and resting upon the lid of the bucket.

Step (5), at 278, can include actuating opening portions on the lid to form apertures providing access to the interior of the bucket. See FIG. 4, for example. Step (6), at 280, can include inserting the downrod, or any other components attached thereto, into an aperture formed by removal of the opening portions of step (5) at 278, such as that shown in FIG. 5, until the fan assembly as preassembled rests on the lid as shown in FIG. 6.

Step (7), at 282 can include assembling the ceiling fan assembly with the remaining ceiling fan components. Such components can include, in non-limiting examples, motor housings, switch housings, light kits, blade irons, blade medallions, fan blades, or electrical connections, such as those electrically coupling a switch housing or a light kit.

After assembly of the fan in step (7), in step (8) at 284, the fan can be removed from the bucket by removing the downrod from the aperture formed in the lid. At step (9) at 286, the fan can be suspended from a structure. In one example, the fan can be suspended from a hanger bracket, such as that represented in FIG. 10. Step (10) at 288 can include electrically coupling the fan, such as that also shown in FIG. 10. Electrically coupling the fan, in step (10), can optionally occur prior to step (9) at 286 in the case of a low-profile fan, for example. Step (11) at 290 can include securing a canopy to the bracket, in order to hide the hanger bracket and the aperture in the ceiling from view. Finally, step (12) at 292 can include returning the opening portions to the lid to close the apertures for future use of the bucket having a complete lid. Alternatively, in the case where the opening portions are not returnable to the lid, the apertures will remain.

It should be appreciated that the order of the steps as shown is non-limiting. While some steps are necessary to complete before others, many steps can be completed at variable times relative to other steps. As such, the assembly of the fan should not be limited as shown and described.

A method of supporting components for assembly of a ceiling fan packaged in a bucket with a lid, the components including a motor assembly having a motor shaft, can include supporting the motor assembly on an end of the bucket such that the components of the ceiling fan can be mounted to the motor assembly. Supporting the motor assembly on the end of the bucket can further include supporting the motor assembly while a downrod extends through the end an interior of the bucket, such as illustrated in FIGS. 5 and 6. A ball mount can also couple to the downrod while the downrod extends through the end and into the interior of the bucket. Furthermore, supporting the motor assembly can include supporting the motor assembly with one or more blade irons are attached to the motor assembly. Additionally, supporting the motor assembly can include supporting the motor assembly with one or more blades, corresponding to the one or more blade irons, are attached to the motor assembly at the blade irons, such as that shown in FIG. 8. Alternatively, the blades can couple directly to the motor assembly, without the intermediate blade irons. Further still, supporting the motor assembly can include supporting the motor assembly with a light kit is attached to the motor assembly, such as that of FIG. 9. Further yet, supporting the motor assembly can include supporting the motor assembly with a switch housing is attached to the motor, such as that of FIG. 8.

Additionally, supporting the motor assembly on an end of the bucket can include supporting the motor assembly on the lid. Supporting the motor assembly on a lid can further include supporting the motor assembly while a downrod extends through an aperture on the lid and into the interior of the bucket, such as that of FIGS. 5 and 6. Furthermore, supporting the motor assembly can include supporting the motor assembly with at least one side aperture on the lid. Further still, supporting the motor assembly can include supporting the motor assembly with two opposite side apertures on the lid.

It is common for a ceiling fan installer to assembly the ceiling fan before mounting the ceiling fan to the ceiling or building. However, the installer is typically required to find a clear workable surface to install the ceiling fan. Often this surface must be large to handle the size of the ceiling fan. The bucket enables assembly and installation of the ceiling fan at any location and does not require an available workspace.

It should be appreciated that the bucket for packaging and installing a ceiling fan is adaptable to operate both as a container for storing, shipping, displaying, and selling the ceiling fan, as well as assisting a consumer or an installer in assembling and installing the ceiling fan. Traditional ceiling fan packaging, such as using boxes with packing materials, is wasteful and does not provide any assistance for installing the ceiling fan. Additionally, the traditional packaging utilizes cardboard boxing, which can be susceptible to damage. The plastic of a bucket is much more durable than the standard cardboard box package.

Additionally, in one non-limiting example, the buckets used for packaging can be made of No. 2 recyclable plastic, and can have a 100% recyclable package, which can be desirable to consumers. In another non-limiting example, any sort of foam utilized within the bucket can be recyclable foam or similar recyclable or biodegradable packing materials.

Furthermore, after assembling and installing the ceiling fan, the consumer keeps the bucket for personal use. Many consumers would prefer the bucket as remainder from the ceiling fan, as opposed to disposing of the traditional ceiling fan packaging.

The bucket can also be easier for a manufacturer to stack and store, with multiple buckets comfortably stacking on one another minimizing concern for damage to buckets at the bottom of the stack. Further, the bucket provides for easy, one-handed transport by the handle. Additionally, at a job-site, such as for building a house, the bucket can be advantageous in protecting the interior ceiling fan, keeping the ceiling fan dry and minimizing the potential for damage.

Figure 16:
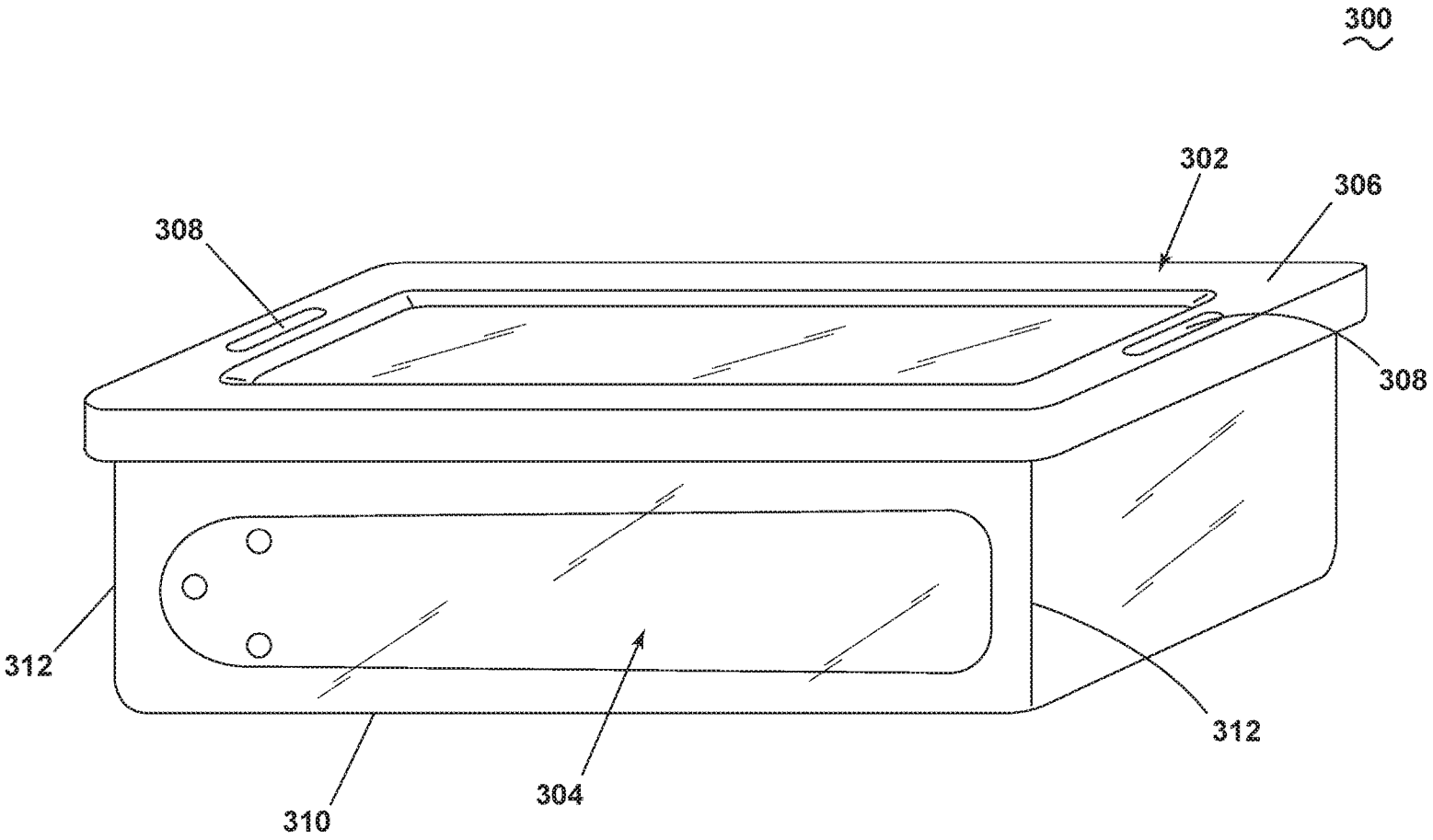
FIG. 16 is a perspective view of another exemplary container for a ceiling fan having a lid and a body.
Figure 17:
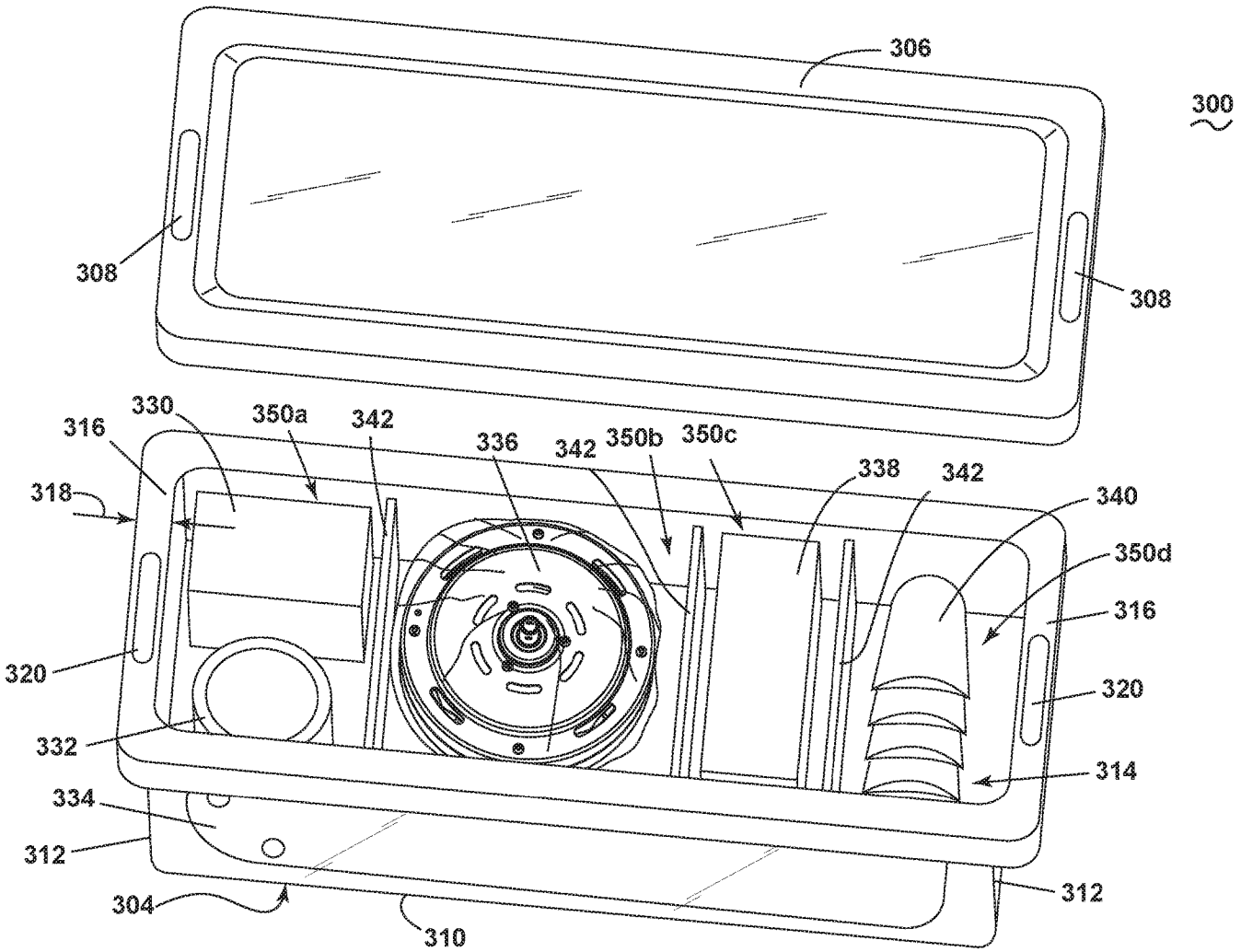
FIG. 17 is an exploded view of the container of FIG. 16 with the lid exploded from the body showing dividers organizing the container into sections.

Referring now to FIG. 16, another exemplary container 300 can include a lid 302 and a container body 304. They container 300 can be an alternative embodiment of the bucket 10 of FIG. 1, or any bucket described herein, having a rectilinear platform. The lid 302 can include a rim 306 configured to couple the lid 302 to the body 304. Alternatively, any suitable connection mechanism for releasably coupling the lid to the body 304 is contemplated, such as a latch or interference fit in non-limiting examples. A pair of handles 308 are provided in the lid 302 facilitating handling of the container 300. Alternatively, the handles 308 can be molded into the container 300. While shown as aperture-style handles, any suitable handle or carrying feature can be incorporated into the container 300 or lid 302 facilitating handling or carrying of the container 300. A bottom wall 310 of the body 304 can extend to a set of sidewalls 312. The lid 302 or body 304 can optionally include ribs or other suitable features formed in the bottom wall 310 or the sidewalls 312 for increasing the structural integrity of the container 300 in order to facilitate transport and stacking of multiple of the containers 300. The container 300 can be transparent or translucent, for example, permitting a viewer, such as a prospective purchaser, to view contents of the container 300, while any coloring or opacity for the container 300 is contemplated.

Referring now to FIG. 16, the lid 302 is exploded from the body 304 exposing an interior 314 of the body 304 defined by the bottom wall 310 and the sidewalls 312. A lip 316 can form an upper terminal surface for the sidewalls 312, opposite of the bottom wall 310. The lip 316 can have a thickness 318, complementary to the rim 306 of the lid 302, such that the lid 302 couples to the body 304 by aligning the rim 306 with the lip 316. A set of handle apertures 320 can be formed in the lip 316 complementary to the handles 308 of the lid 302 providing for simultaneously grabbing of the body 304 and the lid 302 when connected.

The interior 314 of the body 304 is shown filled with exemplary ceiling fan components and storage materials including a first box 330, a canopy 332, a set of fan blades 334, a motor 336, a second box 338, and a set of light glasses 340. Additionally, a set of dividers 342 are provided in the interior 314 separating one or more of the storage materials from one another. It should be understood that the components as shown and described are exemplary, and can include any number or type of suitable components for a ceiling fan including but not limited to: a hanger bracket, a canopy, a ball mount assembly, a downrod, a motor coupler, a motor, a motor housing, a set of blades, a set of blades irons, a switch housing, a light kit assembly, a light fixture, light spindle, light glasses, fasteners, electrical wiring, electrical connectors, or pull strings. One or more of these items may be stored in the first or second boxes 330, 338, such as the fasteners or blade irons, for example, to prevent separation within the container during shipping, moving, or display. The interior 314 should be sized to suitably carry the particular elements required for assembly of the ceiling fan. In addition to the dividers 342, any suitable packaging materials can be provided in the interior 314, such as soft or cushioned materials, such as cardboard or foam, to prevent damage during shipping, moving, or display.

The dividers 342, for example, can be cardboard dividers, and may be color-coded. The dividers 342 can separate the interior 314 into one or more sections, shown as an exemplary first section 350*a*, a second section 350*b*, a third section 350*c*, and a fourth section 350*d*. The sections 350*a-d* may be identified by the color of the dividers 342 to facilitate assembly of the ceiling fan or instructional guidance thereof. The blades 334 can at least partially define the sections 350*a-d* with the dividers 342, as shown, or alternatively can be separated by their own dividers 342. The sections 350*a-d* can be used to securely package the contents of the container 300, as well as organize the contents into relevant area for assembling and installing a ceiling fan. As such, the sections 350*a-d* can form zones or groupings, which can be used to facilitate installation and assembly of a ceiling fan. For example, the portions which will be assembled near the ceiling, such as the hanger bracket and canopy can be stored in one section 350*a-d*. In another example, elements that are attached to the motor, such as the motor coupler, downrod, or a hanger ball can be stored in another section 350*a-d*. In yet another example, elements that are related to the light kit assembly, such as a light spindle, light glasses, and bulbs can be stored in yet another section 350*a-d*. Furthermore, instructions can be included that guide installation based upon completion of a portion of assembly by utilizing all of the elements within a particular section 350*a-d*, zone, or grouping. Additionally, some portions of the ceiling fan can be preassembled by the manufacturer. One particular example can include assembling a motor within a motor housing prior to packaging within the container 300.

The container 300 can be made of a recyclable material, such as a recyclable plastic material. Additionally, the packaging materials, such as the dividers 342 can be made of recyclable materials, such as cardboard. The container 300 can be a transparent or translucent plastic, or may be colored to identify the particular manufacturer or ceiling fan. Additionally, a logo or trademark can be formed into the plastic of the container 300. Optionally, the container 300 can be sized to suit any type of ceiling fan, such as that having differing blade lengths or mounting styles. Furthermore, non-traditional shapes are contemplated, such as a container 300 including an elongated section to carry extra-long blades. The container 300 can be reusable by the consumer or end-user, where the stackable-type container having a traditional shape may be more desirable than a bucket or uniquely shaped container.

The container 300 can provide for organized packaging, shipping, and display for a ceiling fan, as well as arranging similar components into particular sections 350*a-d*, zones, or groupings, which can facilitate assembly and installation of the ceiling fan. Assembly of the ceiling fan contained within the container 300 can be completed similar to a typical ceiling fan assembly. The container 300 is not used to assemble the ceiling fan, similar to the bucket 10 of FIG. 1 and as described herein. However, the instructions can include steps tailored to particular assembly steps related to the assembly of components held in the particular sections 350*a-d*, zones, or groupings. Such assembly can facilitate assembly by improving identification of particular components and assembly sequence for a user. After assembly, the container 300 can be used as a storage container 300 by the user, installer, or consumer.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A kit for a ceiling fan comprising:
an electric motor having a motor shaft;
fan blades rotatable about the electric motor configured to move a volume of air;
a bucket having an interior and storing the electric motor and the fan blades;
a lid removably coupled to the bucket enclosing the interior wherein the lid includes opening portions forming a portion of the lid which are removable from the remainder of the lid to change the lid to an assembly platform for assembling the ceiling fan; and,
at least one partition dividing the bucket into at least two chambers;
wherein the electric motor is provided in a different chamber than the fan blades.

2. The kit of claim 1 wherein the opening portions include a central opening portion.

3. The kit of claim 2 wherein the central opening portion has a triangular shape.

4. The kit of claim 3 further comprising a downrod wherein the central opening portion is adapted to receive insertion of the downrod.

5. The kit of claim 1 wherein the opening portions further include side opening portions.

6. The kit of claim 1 wherein the fan blades are arranged around the electric motor within the bucket.

7. The kit of claim 6 wherein the electric motor is provided at a bottom of the bucket in the interior.

8. The kit of claim 1 wherein the fan blades at least partially define at least one of the chambers.

9. The kit of claim 1 further comprising an instruction manual with instructions for assembly of the ceiling fan.

10. A kit for a ceiling fan comprising:
an electric motor having a motor shaft;
fan blades rotatable about the electric motor configured to move a volume of air;
a bucket having an interior and storing the electric motor and the fan blades; and
a lid removably coupled to the bucket enclosing the interior wherein the lid includes removable portions which can be removed to change the lid to an assembly platform facilitating assembly of the ceiling fan, wherein the removable portions include a central removable portion centered on the lid and wherein the central removable portion has a triangular shape.

11. The kit of claim 10 wherein the removable portions further include side removable portions.

12. The kit of claim 10 further providing at least one partition dividing the bucket into at least two chambers.

13. The kit of claim 12 wherein the electric motor is provided in a different chamber than the fan blades.

14. The kit of claim 13 wherein the fan blades at least partially define at least one of the chambers.

15. A kit for a ceiling fan comprising:
an electric motor having a motor shaft;
a downrod for suspending the electric motor via the motor shaft;
fan blades rotatable about the electric motor configured to move a volume of air;
a bucket having an interior and storing the electric motor and the fan blades; and
a lid removably coupled to the bucket enclosing the interior; and
removable opening portions forming a portion of the lid, and the opening portions are removable to change the lid to an assembly platform for assembling the ceiling fan;
wherein the opening portions include a central opening portion having a triangular shape adapted to receive insertion of the downrod.

16. The kit of claim 15 wherein the opening portions further include side opening portions.

17. The kit of claim 15 wherein the fan blades are arranged around the electric motor within the bucket.

18. The kit of claim 17 wherein the electric motor is provided at a bottom of the bucket in the interior.

19. The kit of claim 15 further providing at least one partition dividing the bucket into at least two chambers.

20. The kit of claim 19 wherein the electric motor is provided in a different chamber than the fan blades.

21. The kit of claim 20 wherein the fan blades at least partially define at least one of the chambers.

22. The kit of claim 15 further comprising an instruction manual with instructions for assembly of the ceiling fan.

23. A kit for a ceiling fan comprising:

an electric motor having a motor shaft;

fan blades rotatable about the electric motor configured to move a volume of air;

a bucket having an interior and storing the electric motor and the fan blades; and a lid removably coupled to the bucket enclosing the interior wherein the lid includes removable portions which can be removed to change the lid to an assembly platform facilitating assembly of the ceiling fan, wherein the electric motor is provided in a different chamber than the fan blades and wherein the fan blades at least partially define at least one of the chambers.

24. The kit of claim 23 wherein the removable portions include a central removable portion centered on the lid.

25. The kit of claim 24 wherein the central removable portion has a triangular shape.

26. The kit of claim 23 wherein the removable portions further include side removable portions.

27. The kit of claim 23 further providing at least one partition dividing the bucket into at least two chambers.

* * * * *